US007574839B1

(12) United States Patent
Simpson

(10) Patent No.: US 7,574,839 B1
(45) **Date of Patent: *Aug. 18, 2009**

(54) ROOF ASSEMBLY HAVING INCREASED RESISTANCE TO SIDELAP SHEAR

(75) Inventor: Harold G. Simpson, Tulsa, OK (US)

(73) Assignee: Harold Simpson, Inc., Edmond, OK (US)

( * ) Notice: Subject to any disclaimer, the term of this patent is extended or adjusted under 35 U.S.C. 154(b) by 267 days.

This patent is subject to a terminal disclaimer.

(21) Appl. No.: 11/107,498

(22) Filed: Apr. 15, 2005

Related U.S. Application Data

(63) Continuation-in-part of application No. 09/978,262, filed on Oct. 15, 2001, now Pat. No. 6,889,478, which is a continuation-in-part of application No. 09/059,146, filed on Apr. 13, 1998, now Pat. No. 6,301,853, which is a continuation-in-part of application No. 08/484,975, filed on Jun. 7, 1995, now Pat. No. 5,737,894, and a continuation-in-part of application No. 08/480,968, filed on Jun. 7, 1995, now Pat. No. 5,692,352.

(51) Int. Cl.
*E04D 1/00* (2006.01)

(52) U.S. Cl. ..... 52/520; 52/545; 52/748.1; 52/528

(58) Field of Classification Search ..... 52/520, 52/528–529, 545, 547, 748.1
See application file for complete search history.

(56) References Cited

U.S. PATENT DOCUMENTS

| | | | |
|---|---|---|---|
| 2,284,898 | A | 6/1942 | Hartman |
| 3,559,359 | A | 2/1971 | Talbert |
| 3,583,121 | A | 6/1971 | Tate et al. |
| 3,740,917 | A | 6/1973 | Wong |
| 3,845,930 | A | 11/1974 | Metrailer |
| 3,998,019 | A | 12/1976 | Reinwall, Jr. |
| 4,099,357 | A | 7/1978 | Lester |
| 4,106,256 | A | 8/1978 | Cody |
| 4,133,161 | A | 1/1979 | Lester |
| 4,155,209 | A | 5/1979 | Schirmer |
| 4,213,282 | A | 7/1980 | Heckelsberg |
| 4,217,741 | A | 8/1980 | Cole |
| 4,269,012 | A | 5/1981 | Mattingly et al. |
| 4,314,428 | A | 2/1982 | Bromwell |
| 4,329,823 | A | 5/1982 | Simpson |
| 4,408,423 | A | 10/1983 | Lautensleger et al. |
| 4,522,005 | A | 6/1985 | Seaburg et al. |
| 4,528,789 | A | 7/1985 | Simpson |
| 4,562,683 | A | 1/1986 | Gottlieb |

(Continued)

*Primary Examiner*—Richard E Chilcot, Jr.
*Assistant Examiner*—Chi Q Nguyen
(74) *Attorney, Agent, or Firm*—Bill D. McCarthy; Fellers, Snider, et al.

(57) ABSTRACT

A roof assembly in which overlapping edges of adjacent panel members are joinable in an assembled mode to provide a seam having resistance to sidelap shear, the roof assembly comprising panels having a female sidelap along one edge and a male sidelap along the opposite edge, the female sidelap having a male insertion cavity and a leg member with a female retaining groove. The male sidelap, engageable in the male insertion cavity of an adjacent panel, has a tang lockingly disposed in the female retaining groove in folded tight adjacency to form a standing seam between panels. The panels are interconnected via backer plate fasteners to increase resistance to side slipping under wind uplift.

21 Claims, 22 Drawing Sheets

U.S. PATENT DOCUMENTS

| | | | | |
|---|---|---|---|---|
| 4,597,234 | A | 7/1986 | Simpson | |
| 4,677,795 | A | 7/1987 | Mathews et al. | |
| 4,686,809 | A | 8/1987 | Skelton | |
| 4,694,628 | A | 9/1987 | Vondergoltz et al. | |
| 4,706,434 | A | 11/1987 | Cotter | |
| 4,819,398 | A | 4/1989 | Dameron | |
| 4,870,798 | A | 10/1989 | Richter | |
| 4,987,716 | A | 1/1991 | Boyd | |
| 5,038,543 | A | 8/1991 | Neyer | |
| 5,142,838 | A | 9/1992 | Simpson et al. | |
| 5,201,158 | A | 4/1993 | Bayley et al. | |
| 5,241,785 | A | 9/1993 | Meyer | |
| 5,303,528 | A | 4/1994 | Simpson et al. | |
| 5,379,517 | A | 1/1995 | Skelton | |
| 5,524,409 | A | 6/1996 | Kaiser | |
| 5,737,894 | A | 4/1998 | Simpson et al. | |
| 6,301,853 | B1 * | 10/2001 | Simpson et al. | 52/520 |
| 6,889,478 | B1 * | 5/2005 | Simpson | 52/520 |

* cited by examiner

ROOF ASSEMBLY HAVING INCREASED RESISTANCE TO SIDELAP SHEAR

RELATED APPLICATIONS

This application is a continuation-in-part of U.S. patent application Ser. No. 09/978,262 filed Oct. 15, 2001, which is a continuation-in-part of 09/059,146 filed Apr. 13, 1998, now U.S. Pat. No. 6,301,853 issued Oct. 16, 2001. U.S. Pat. No. 6,301,853 is a continuation-in-part of U.S. patent application Ser. No. 08/484,975 filed Jun. 7, 1995, now U.S. Pat. No. 5,737,894 issued Apr. 14, 1998, and of U.S. patent application Ser. No. 08/480,968 filed Jun. 7, 1995, now U.S. Pat. No. 5,692,352 issued Dec. 2, 1997.

FIELD OF THE INVENTION

The present invention relates to a roof assembly for a building structure, and more particularly, but not by way of limitation, to a roof assembly having increased resistance to sidelap shear.

BACKGROUND

Numerous types of roof assemblies have previously been proposed for pre-engineered buildings in efforts to provide a watertight roof assembly, while also enabling the roof assembly to expand and contract as changes in temperature are encountered. Typical of such prior art roof assemblies of considerable success in recent years is the standing seam roof assembly.

The panel members of the standing seam roof assembly are joined along lapped together side edges forming the standing seams. The panel members are secured to secondary structural members by either clips or through fasteners. The clips used to attach to the standing seam can be of two types: floating (one or two piece moveable); or fixed (one piece with no movement allowed between the panel and the supporting structure). Through fasteners penetrate the panels and attach the panels to underlying support structure to substantially lock the panels and support structure together so that differential movement is restricted. Roofs may be classified as shed roofs and low slope gasket roofs. Shed roofs are roofs that shed water because gravity pulls the water down and away from panel joints more effectively than wind or capillary action propel water thought the joint. Shed roofs generally occur over slopes of three to twelve or greater. Low slope gasket roofs, on the other hand, provide roof joints that are made watertight by placing gasket material between the panel joints and securing the gasket material in place by, for example, encapsulating or exerting pressure on the gasket material such as by seaming. Generally, low slope gasket roofs have a ¼ to twelve slope or greater.

Heretofore, field seamed gasket joints in large roofs have generally been limited to two-piece clips in which movement between the roof and the underlying structure occurred within the clip. The reason for this is that, in the past, the top hook portion of the clip intersected the gasket sealant, and if the clip hook moved in relation to the panel which held the sealant, the movement of the clip hook deformed and destroyed the gasket seal. Single piece clips have been used freely in small and shed roofs where gasket sealing is not required.

Standing seam metal roof panels exhibit considerable diaphragm strength, and it is desirable to use this strength by interconnecting the panels side to side so that adjacent panels do not slide relative to each other; further, the panels are connected to the support frame to stabilize the support frame, rather than bracing and stabilizing the support frame by other means. In the past, stabilization of the support frame has been achieved by means of separate bracing. On gasket roofs, suitable two-piece floating (moveable) clips have been used to permit the brace and frame to remain fixed while permitting panel movement relative to the frame due temperature gradients and other forces. Alternatively, the length of the panel run was limited to no more than about 40 feet so that the expansion and contraction of the panel did not damage the connections to the underlying support structure.

The desirable result of eliminating detrimental differential movement between the panels of the roof assembly and the support structure on large roofs can also be achieved by constructing the underlying support structure to move slightly to accommodate expansion and contraction of the roof assembly. One means of achieving this is exemplified by the Flex Frame™ support system produced by ReRoof America, Inc. of Tulsa, Okla.

The interconnected panel members of a standing seam roof assembly lend stiffness and strength to a flexible roof structure, while allowing the roof structure to expand and contract as a function of the coefficient of expansion of the panel material and the temperature cycles of the roof panels.

If floating clips or flexible framing are not used, the repeated action of expansion and contraction of the panel member tends to weaken the panel-to-panel lap joints and the panel to framing connection, causing separation, structural failure and roof leakage. Leaks are generally caused by the weakening of the fastening members and working or kneading of the sealant disposed at the joints. Thus, prior art sealants for such roof assemblies have required the qualities of adhesion, flexibility and water repellence. Further, in many instances the pressure on the sealant can vary greatly throughout the length of the sidelap and end lap joints of the panels, resulting in uneven distribution and voids in the joint sealant.

Many of the problems encountered with prior art standing seam roofs, such as structural failures and leaks, are overcome by the standing seam floating roof assembly taught by U.S. Pat. No. 5,737,894 issued to Harold G. Simpson. The standing seam floating roof assembly is formed of elongated metal panels, each of which is provided with a female member formed along one longitudinal edge and a male member formed along the opposed longitudinal edge. Adjacently disposed panels are joined by interlocking female and male members to form the standing seam joint. Clips interconnect the standing seam joints and the supporting structure, with the upper portions of the clips hooking over the male members of the panels. Most such clips are of the sliding type which permit the hooking portions to move relative to supporting base portions connected to the supporting structure, while relative motion between the clip hooks and the metal panels is substantially prevented. A sealant material is disposed to form a moisture dam in the interlocking joints of the female and male members.

In addition to standing seam roof assemblies used in newly constructed pre-engineered buildings, standing seam roof assemblies are also finding increased usage in another segment of the roofing industry, that of the replacement of built-up roofs. Generally, a built-up roof is formed of a plurality of interconnected sections that are sealed by a watertight over coat of asphaltic composition. Such built-up roofs have generally performed well, but problems can be expected with age; from building settlement; and from standing water pockets resulting from construction errors. Standing water usually results in deterioration of the roof, resulting in leaks and other problems.

A need has long been recognized for replacing a roof without making substantial modifications to the existing roof. In addition to economy of fabrication and ease of on-site construction, it is highly desirable that a newly erected roof assembly provide a new roof surface independent of the variations in the surface of the preexisting roof. Past repair methods, especially those capable of altering the roof slope to improve drainage, are excessively time consuming and require both substantial destruction of the original roof and extensive custom construction, thus exposing the building and its contents to damage by the elements during the reroof construction.

SUMMARY OF THE INVENTION

The present invention provides a roof assembly in which adjacently disposed roof panels are supported by underlying support structure in overlapping edge relationship. The overlapping edges of adjacent panel members are joinable in an assembled mode to provide a seam having resistance to sidelap shear, the roof assembly comprising panels having a female sidelap along one edge and a male sidelap along the opposite edge, the female sidelap having a male insertion cavity and a leg member with a female retaining groove. The male sidelap, engageable in the male insertion cavity of an adjacent panel, has a tang lockingly disposed in the female retaining groove in folded tight adjacency to form a standing seam between panels.

The sidelap shear capacity of the roof panels is increased in one embodiment by backer plates disposed on opposing sides of the standing seams and fastened together to sandwich together the female and male sidelap portions so the standing seams have increased resistance to side slipping under wind uplift. In another embodiment, cinch plates are supported against the roof panels between the standing seams and connected to underlying support members.

The features, benefits and advantages of the present invention will become apparent from the following detailed description when read in conjunction with the drawings and appended claims.

BRIEF DESCRIPTION OF THE DRAWINGS

FIG. 28 is an end view of the two-piece roof clip assembly of FIG. 26.

DETAILED DESCRIPTION

Figure 1:
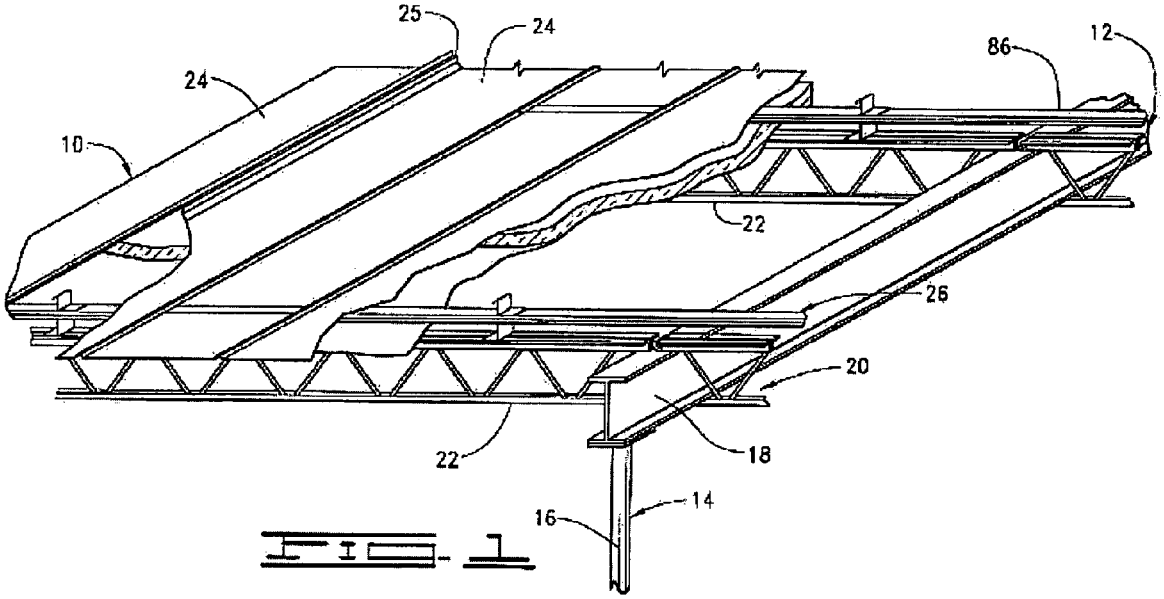
FIG. 1 is an isometric, partial cut-away view of a portion of a roof system utilizing the standing seam roof assembly of the present invention.

Referring to the drawings generally, and more particularly to FIG. 1, shown therein is a pre-engineered building roof 10 as supported by a pre-engineered building structure 12. The pre-engineered structure 12 comprises a primary structural system Sect. which consists of a plurality of upwardly extending column members 16 that are rigidly connected to a foundation (not shown). Also, the primary structural system 14 has a plurality of generally sloping primary beams 18 which are supported by the column members 16.

A secondary structural system 20 comprises a plurality of open web beams 22, also called bar joists, supported by the primary beams 18 generally in horizontal disposition. It will be understood that cee or zee purlins, or wood beams, can be used as the secondary structurals in lieu of the bar joists 22 in the practice of the present invention.

A plurality of roof panels 24 are supported over the secondary structural assembly 20 by a plurality of panel support assemblies 26 and are attached to the upper flanges of the bar joists 22. The roof panels 24, only portions of which are shown, are depicted as being standing seam panels with interlocking standing seams 25 connected by clip portions of the panel support assemblies 26.

Figure 2:
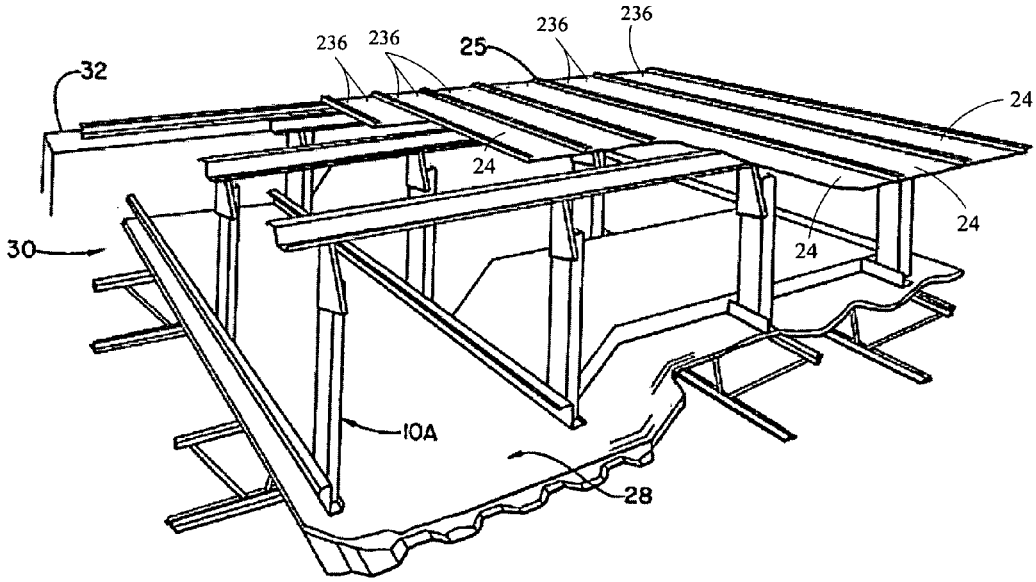
FIG. 2 is another partially cut-away view of a portion of another re-roof system utilizing the standing seam roof assembly of the present invention.

The present invention can as well be supported above an existing roof in a re-roof installation. FIG. 2 shows a portion of a roof system 10A supported by a preexisting roof 28 of a building structure 30 having wall members 32. The preexisting roof 28 can be any preexisting roof structure such as a built-up roof connected to and supported by conventional primary and secondary support elements.

Whether in a new roof installation as depicted in FIG. 1, or in a reroof installation as depicted in FIG. 2, the roof panels 24 are secured at the interlocking side lap joints and at the end overlap of contiguous panels. Fastener penetration of the roof panels 24, except at the end overlaps and roof perimeters, is avoided to minimize leakage points. To maintain water tightness at points of attachment to underlying structure, the roof panels 24 must be permitted to expand and contract in relation to the underlying structure, or the roof panels 24 and the underlying structure must be permitted to move in unison without unduly straining or fracturing the panels. This may be accomplished by limiting the length of the roof panels 24 or by utilizing support structures sufficiently flexible to allow the attachment means to move with the expansion and contraction of the panels. The flexibility of the support structurals must be greater for longer panel runs because, other factors being equal, the expansion and contraction of the panels will be greater.

Past practice has been to attach the center and sidelap joints with either penetrating or non-penetrating fasteners. For non-penetrating fasteners, it has been common to use either a fixed or sliding clip with a minimum length contact surface between the hold-down portion of the clip and the top of the male leg of the seam. The length of the clip has been held to a minimum, resulting in stress concentrations in the panel at the point of attachment, leading to severe distortion in the panel joints as the panels are subjected to wind uplift.

In prior art standing seams, the standing seam clip bears only on the male seam portion of the panel inserted into the adjacent female seam portion. The female seam portion is not retained directly by the clip, and as a result, the load from the female seam portion must pass through the male seam portion and into the clip where the load can, in turn, pass to the secondary structural. This action tends to "unravel" or "unzip" the panel joint and allows distortions over the short section retained by the clip. This has resulted in premature panel failure from wind uplift.

A roof panel is usually attached to underlying supporting structure in a manner that causes the panel to act as a three or four span continuous beam. This arrangement substantially reduces the maximum moment occurring at any one point compared to the moment that would occur in a simple beam, other factors being equal. However, this can cause a negative moment to occur at the attachment point. This negative moment peaks and drops off very quickly as the panel section moves from the center line of the attaching clip towards the point of inflection (P.I.), the point of inflection being that point where the moment in the panel changes from positive to negative.

Past center hold-down practice has been to coordinate usage of floating clips with eave and ridge hold-down means so that if floating clips were used to attach the center of the panel to the underlying structural, then fixed clips were used to attach the eave or ridge portions of the panel to the underlying structural. Conversely, if the panel edge attachment consisted of a floating, (two-piece, moveable) non-penetrating attachment means, such as a clip, then the center hold-down was a fixed attachment. However, in the past non-penetrating floating hold-down devices have largely been complex and expensive.

The effectiveness of non-penetrating center hold-down devices is influenced by the number and height of corrugations formed in the panel, and by the width, thickness and strength of the metal laterally separating the corrugations. The configuration and number of panel corrugations in turn has a direct impact on the efficiency of material utilization, which is a primary cost factor. Conventional standing seam roofs may only achieve a flat-width-to-coverage ration as low as 1.25:1 where through fasteners exist only at panel end laps and do not occur at the panel centers. On the other hand, non-standing seam panels with penetrating center hold-down fasteners are commonly 36 inches wide and may achieve flat-width-to-coverage ratios as low as 1.17:1

Figure 3:
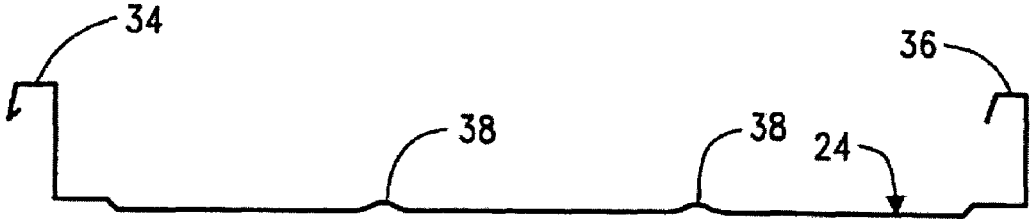
FIG. 3 is an end view of the profile of a roof panel member which can be utilized in the roof system of FIGS. 3 and 4.
Figure 4:
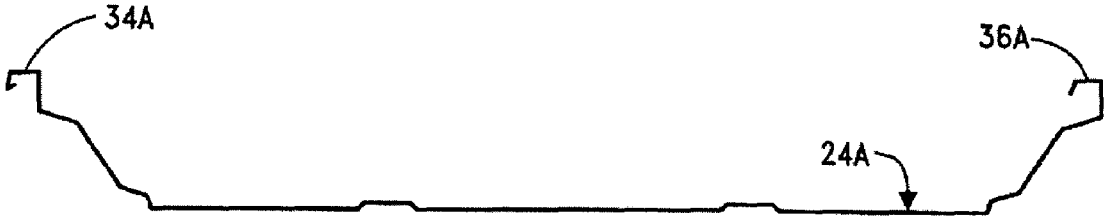
FIG. 4 is an end view of the profile of an alternative roof panel member which can be utilized in the roof system of FIGS. 1 and 2.

As shown in FIG. 3, the roof panel 24 has a substantially flat pan profile between a female sidelap portion 34 and a male sidelap portion 36. The medial portion of the roof panel 24 can have a number of corrugations 38 of a selected height for the purpose of stiffening the panel. FIG. 4 shows an alternative roof panel 24A having trapezoidal sidelap portions 34A, 36A to improve the panel material utilization in relation to roof coverage. That is, all else being equal, the roof panel 24 of FIG. 3 requires a wider metal blank sheet than does the roof panel 24A of FIG. 4.

Figure 5:
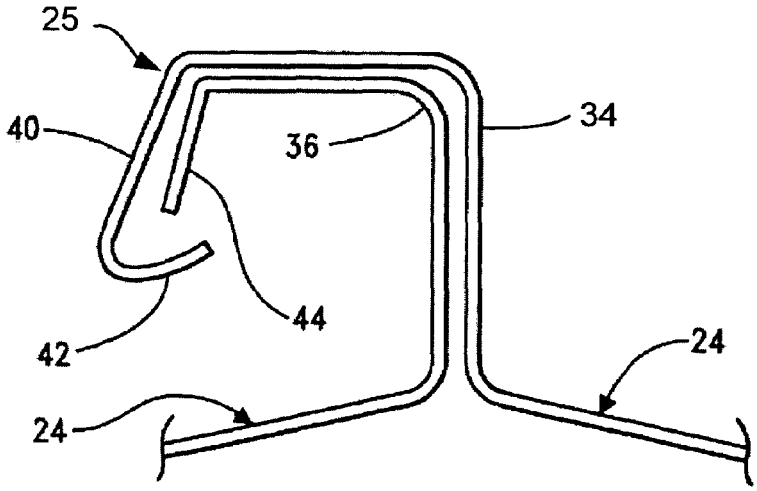
FIG. 5 is an end view of the profile of a portion of the male sidelap portion interlocked with a portion of the female sidelap portion of the roof panel members of FIG. 1 and FIG. 2.

Adjacent roof panels 24 are interlocked with the female sidelap portion 34 wrapped around the male sidelap portion 36, as shown in FIG. 5. It will be noted that outwardly angled leg 40 of the female sidelap 34 is provided with a hook 42 at its a distal end for sliding engagement past a tang portion 44 of the male sidelap 36 as the two adjacent roof panels 24 are joined. In this manner, the panel profile of the present invention provides for an ease of initially assembling and interlocking the male sidelap 36 with the female sidelap 34; that is, the female sidelap 34 can be dropped vertically onto the male sidelap 36. This provides a superior method of joining panels in comparison to the well known "roll-to-lock" method wherein one panel must be rotated upwardly in order to interlock and then rotated downwardly into a final position.

It will be further noted that FIG. 5 shows the interlocked adjacent roof panels 24 forming the standing seam 25 in an unseamed condition; that is, once interlocked as shown, mechanical seaming may be used on the standing seam 25 to provide the final relationship between the male sidelap portion 36 and the female sidelap portion 34. An attachment clip can also be gripped between the male sidelap portion 36 and the female sidelap portion 34 for attachment to the underlying roof structure, as will be discussed below.

Figure 6:
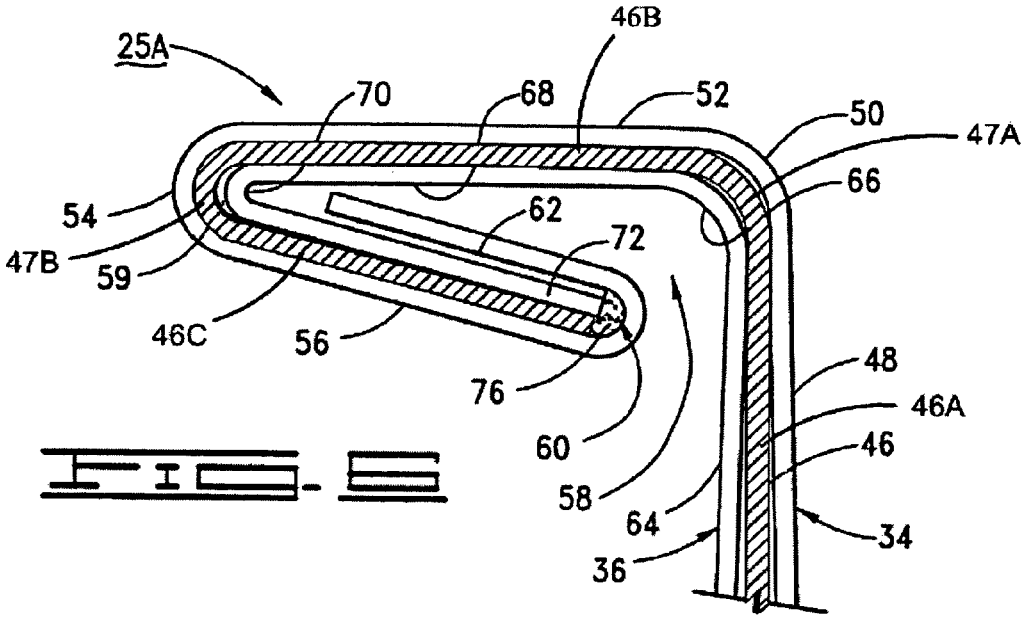
FIG. 6 is an elevational view of the standing seam assembly between adjacent panels in the final formed configuration.

FIG. 6 shows a standing seam 25A, which is identical to the standing seam 25 of FIG. 5 with the exceptions that the upper portion of a roof clip 46 is sandwiched between the female sidelap 34 and the male sidelap 36, after which the standing seam 25A has been field formed by a seaming operation. It will be understood that the roof clip 46 has a lower portion that extends beneath the roof panels 24 and is connected to the building support structurals, such as the secondary structural system 20.

The female sidelap 34 has a female first leg member 48, a female first radiused portion 50, a female second leg member 52, a female second radius portion 54 and a female third leg member 56 which together form a female first cavity 58 and a female second cavity 59 (also sometimes herein referred to as the first and second male insertion cavities, respectively), for receiving the male sidelap 36. A female retaining groove 60 is disposed at a distal end of the female third leg member 56, an extended female fourth leg portion 62 (the hook 42 in FIG. 5) extending from the female third leg member 56 to form the female retaining groove 60.

The male sidelap 36 has a male first leg member 64, a male first radius portion 66, a male second leg member 68, a male second radius portion 70 and a male third leg member 72, also referred to as the male tang member 72, disposed in the female first cavity 58. The male second radius portion 70 is disposed in the female second cavity 59, and a distal end of the male tang member 72 is disposed in the female retaining groove 60.

The roof clip 46 has a clip first leg member 46A; a clip second leg member 46B; a clip third leg member 46C; the roof clip 46 also has a clip first radius portion 47A and a clip second radius portion 47B, as shown. For clarity of presentation, the numerical designation of the roof clips in the appended figures will all be designated by the number 46, even though there are some variations in the geometrical configurations of the roof clips. Furthermore, the roof clip 46 in each of the figures will be cross-hatched to aid the reader in distinguishing the assembled components of the various embodiments of the standing seams described herein.

In FIG. 6, the roof clip 46 is sandwiched between the female sidelap 34 and the male sidelap 36. The clip first radius portion 47A is shaped to conform to the curvature of the female first radius portion 50 and the male first radius portion 66. The clip second radius portion 47B lockingly engages the male second radius portion 70 in the female second cavity 59, the roof clip 46 thereby attaching the male sidelap 36 to the underlying building structural system.

The distal end of the clip third leg member 46C is lockingly engaged in the female retaining groove 60 formed by the female third leg member 56 and the female fourth leg member 62. A mastic material 76 is disposed in the female retaining groove 60 to sealingly engage the distal end of the male tang member 72 of the roof clip 46, thereby providing a watertight seal for the standing seam 25A.

In the installed mode of the standing seam 25A after field seaming, as depicted in FIG. 6, the standing seam 25A has a triple lock integrity. That is, the standing seam 25A formed by the interlocking engagement of the female and male sidelaps 34, 36 is secured by the male first radius portion 66 in the female first radius portion 50; the male second radius portion 70 in the female second radius portion 54; and the male third leg member, or the male tang member, 72 in the female retaining groove 60.

In addition to the aforementioned locking engagements of the standing seam 25A, the male tang member 72 acts as a locking tab that engages the female retaining groove 60 to resist unfurling or unzipping by uplift forces. As the panels forming the standing seam 25A are subjected to uplift forces, such as by wind, pivoting disengagement is attempted by the separation of these members, and as this occurs, the male tang member 72 and female retaining groove 60 permit some upward flexing of the adjacent roof panels 24 while maintaining the latching integrity of the sidelap portions 34, 36 and closure of the standing assembly 25A.

Figure 7:
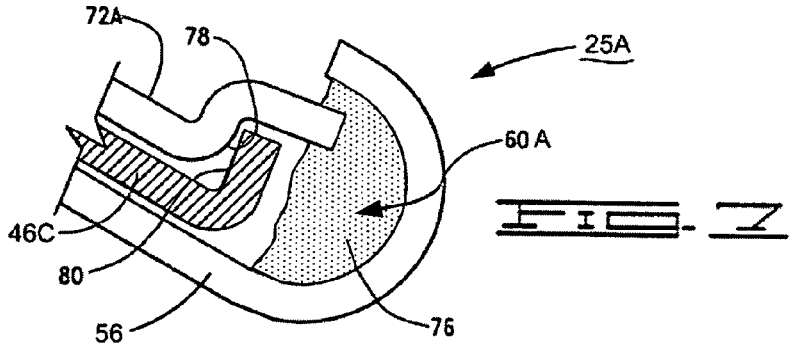
FIG. 7 is an elevational view of a portion of the standing seam assembly of FIG. 6, showing an alternative configuration of the male sidelap portion and the retaining clip.

FIG. 7 shows a portion of an alteration to the standing seam 25A of FIG. 6, wherein the female retaining groove 60 contains a mastic 76, but in this embodiment, only the male tang member 72A is sealingly engaged by the mastic 76, and not the proximal end of the clip third leg member 46C. The male tang member 72A forms a shoulder 78 which pressingly engages an opposing shoulder 80 formed at the proximal end of the clip third leg member 46C. In this manner the roof clip 46 abuttingly engages the male sidelap 36 to provide a positive support thereof. This positive engagement of the roof clip 46 against the male tang member 72A reduces the amount of field seaming required to form the standing seam assembly 25A. Thus, the female retaining groove 60A can be preformed, and the male sidelap 36 and the roof clip 46 simply assembled together and placed into the female retaining groove 60A. Such assembly simplifies installation by reducing the field seaming operation to one simple bend of the assembly at radii 54, 70, and 47B.

Another advantage provided by the roof-clip 46 not being engaged by the mastic 76 is that the roof clip 46 can float without disrupting the seal with the mastic 76. This advantage of this will become clear from the discussion of a two-piece roof clip that follows below.

Figure 8:
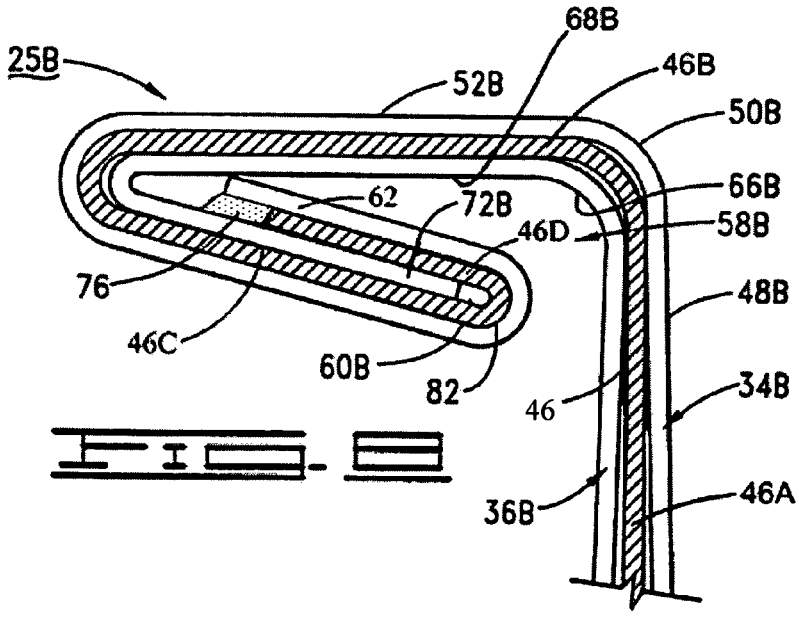
FIG. 8 is an elevational view of an alternative preferred embodiment of the standing seam assembly of FIG. 6.

FIG. 8 shows a standing seam 25B in which, like the standing seam 25A of FIG. 6, the female second leg member 52B is substantially perpendicular to the female first leg member 48B. Here, however, the roof clip 46 is formed to have a retaining groove 82 in which the proximal end of the male tang member 72B of the male sidelap 36B is disposed; and wherein the retaining groove 82 is positioned in the female retaining groove 60B of the female sidelap 34B. In this embodiment, the end of the female fourth leg member 62 is contiguous to the end of the clip fourth member 46D, and the mastic 76 is placed to seal the ends of the female sidelap 34B and the roof clip 46 (in addition to, or in lieu of, being placed in the female retaining groove 60B).

Figure 9:
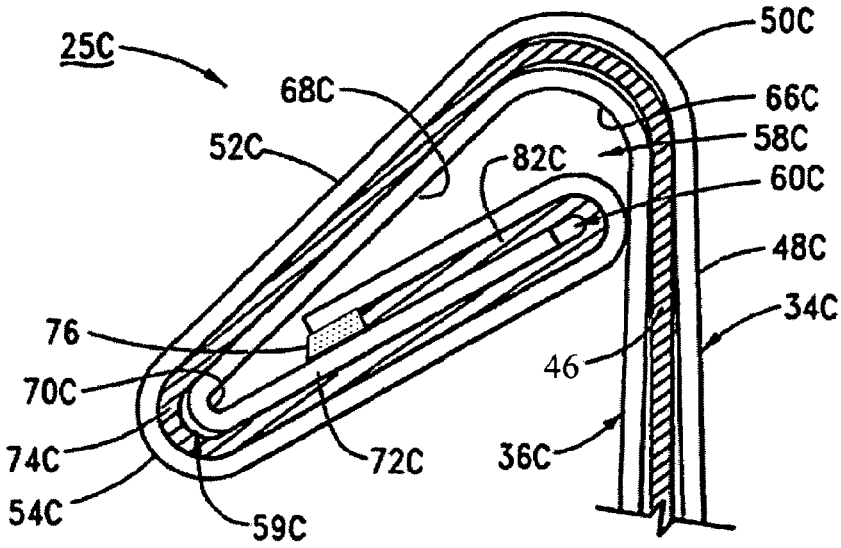
FIG. 9 is an elevational view of an alternative preferred embodiment of the standing seam assembly of FIG. 6.

FIG. 9 shows another embodiment of a standing seam 25C wherein the standing seam 25B of FIG. 8 has been further seamed or foamed to be rotated downwardly to create an acute angle with respect to the female first leg member 48C. The standing seam 25C provides a tighter and stronger, more watertight seam, because the over-bending of the male and female sidelaps 36C, 34C and the roof clip 46 requires a longer arc length for female first radius portion 50C, and this draws the female retaining groove 60C very tightly against the male tang member 72C.

Figure 10:
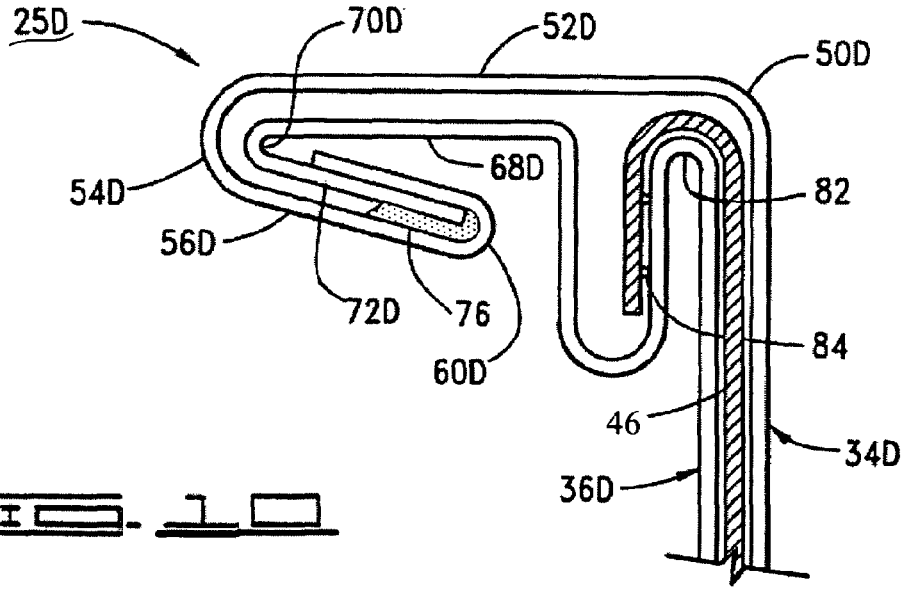
FIG. 10 is an elevational view of an alternative standing seam assembly between adjacent panels in the final formed configuration to resist in plane shear movement.

FIG. 10 is yet another embodiment of a standing seam 25D wherein roof clip 46 grips male sidelap 36D at a radius portion 82 when the panel is subjected to uplift or diaphragm loads, that is, shear loads in the plane of the roof between panels. This separates the support of the roof clip 46 from the seamed portion so that the clip is not inserted in the sealingly engaged ends of female sidelap 34D and male sidelap 36D. The roof clip 46 can be provided a number of serrated teeth 84 to improve the gripping action on both the male sidelap 36D and female sidelap 34D to increase resistance to in plane panel sidelap shear or relative movement between adjacent panels.

The roof clip 46 as configured in FIG. 10 provides several advantages. Namely, the roof clip 46 is simple to manufacture and can be made from heavy stiff material to provide diaphragm strength between panels.

Figure 11:
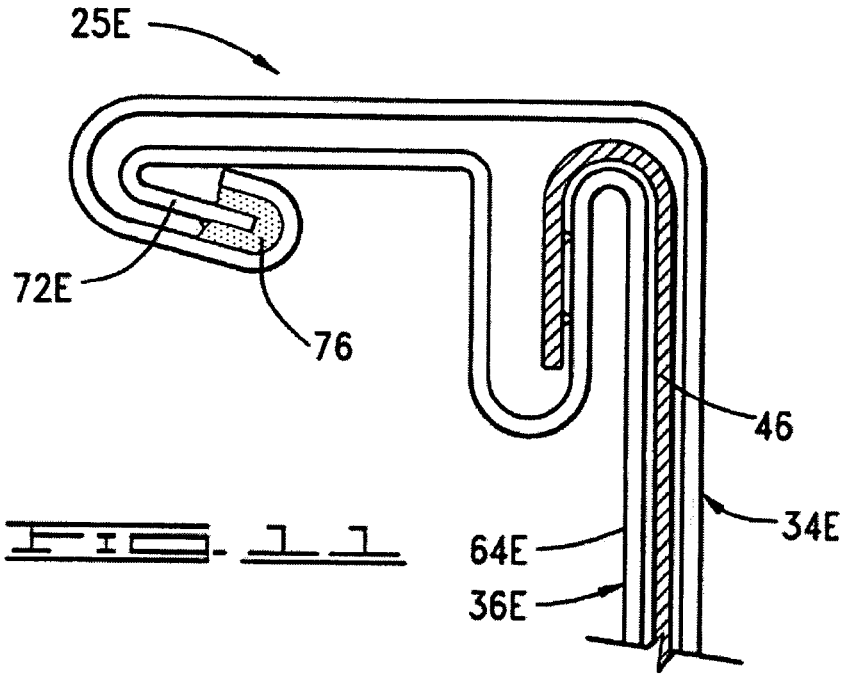
FIG. 11 is an elevational view of an alternative preferred embodiment of the standing seam assembly of FIG. 10.
Figure 12:
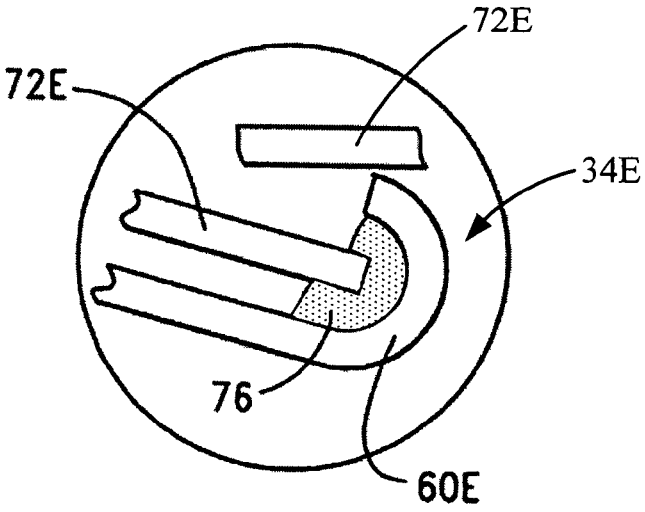
FIG. 12 is a detail view of a portion of the standing seam assembly of FIG. 11.

FIG. 11 shows another embodiment with of a standing seam 25E which, like the standing seam 25D of FIG. 10, separates the engagement between the roof clip 46 and the male sidelap 36E from the ends of the male sidelap 36E and the female sidelap 34E that are sealed by the mastic material 76. This separation provides for transfer of uplift forces from the roof clip 46 into the male seam as depicted in FIG. 12, wherein the male tang member 72E has a proximal end disposed in the mastic material 76 in the female retaining groove 60E, both of which move in unison as the panels expand and contract in relation to the roof clip 46.

All of the embodiments of the standing seams 25A-25E discussed above have a female sidelap 34 which forms a female retaining groove 60 that lockingly engages a male tang member 72 of the male sidelap 36. This engagement drives the male tang member 72 into ever more pressing engagement with the retaining groove as uplift forces tend to separate the female first leg member 48 of the female sidelap 34 from the male first leg member 64 of the male sidelap 36. The locking characteristic of this seam is not limited to seams having female sidelaps which form the female retaining groove 60, for an equivalent embodiment would be to have the male sidelap 64 form the retaining groove 60.

Figure 13:
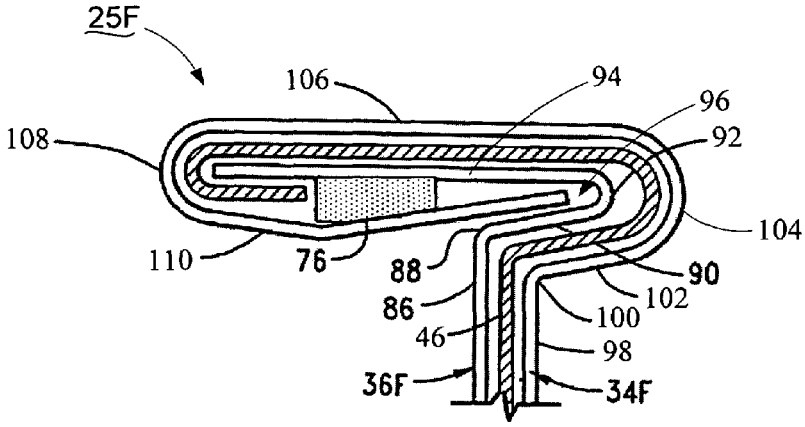
FIG. 13 an elevational view of an alternative standing seam assembly between adjacent panels in the final formed configuration.

FIG. 13 shows one other embodiment with a standing seam 25F wherein the male sidelap 36F has a male first leg member 86; a male first radius portion 88; a male second leg member 90; a male second radius portion 92; and a male third leg member 94. The male second leg member 90 and the male third leg member 94 form a male retaining groove 96 at the bend of the male second radius portion 92.

The female sidelap 34F has a female first leg portion 98, a female first radius portion 100, a female second leg portion 102, a female second radius portion 104, a female third leg portion 106, a female third radius portion 108, and a female sixth leg portion 110, the female sixth leg portion 110 also referred to herein as the female tang, or tab, member 110. A mastic material 76 is appropriately disposed to sealingly engage the ends of the female sidelap 34F and the male sidelap 36F, and the roof clip 46 in this embodiment is formed to have an end portion that wraps around the male sidelap 36F for locking engagement therewith.

In the seamed configuration shown in FIG. 13, the female tang member 110 has an end portion disposed in the male retaining groove 96 of the male sidelap 36F. Uplift forces which tend to separate the male first leg portion 86 (male sidelap 36F) from the female first leg portion 98 (female sidelap 34F) will drive the female tang member 110 into ever more pressing engagement with the male retaining groove 96, thereby resisting the unfurling or unzipping of the standing seam 25F. This will be discussed more fully below.

Having discussed the configuration of the characteristic locking engagement of the tang member and the retaining groove of the roof panel of the present invention, attention will now be directed to the method of field seaming the standing seam and of attaching the standing seam to the underlying support, such as the panel support assembly 26.

Figure 14:
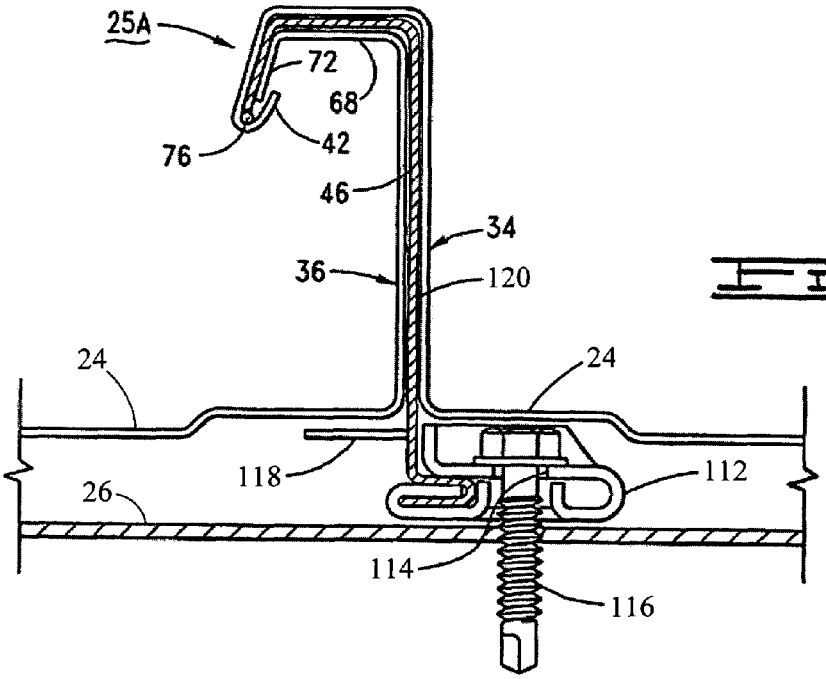
FIG. 14 is an elevational view of an alternate standing seam assembly of FIG. 6 before the field seaming operation is performed.

FIG. 14 shows the standing seam 25A of FIG. 6 in an unseamed condition. During assembly, the roof clip 46 is placed over the male sidelap 36, and the female sidelap 34 is then placed over both. In this manner, the hook 42 of the female sidelap 34 is deflected as it passes by the male tang member 72 (of the male sidelap 36) and is positioned there below. It will be noted that the mastic material 76 is supported within the female sidelap 34 before field seaming.

The roof clip 46 as shown in FIG. 14 is of a two-piece construction having an attachment end 112 with an aperture 114 through which a fastener 116 is attached in threading engagement with the underlying structure, such as in the attachment of the roof clip 46 to the panel support assembly 26 (or directly to the bar joist 22). The roof clip 46 has a support shelf 118 for supporting the male sidelap 36 during the assembly and seaming of the standing seam 25A. Further, the roof clip 46 has an upstanding web portion 120 which supports the male tang member 72 at an end portion thereof.

Figure 15:
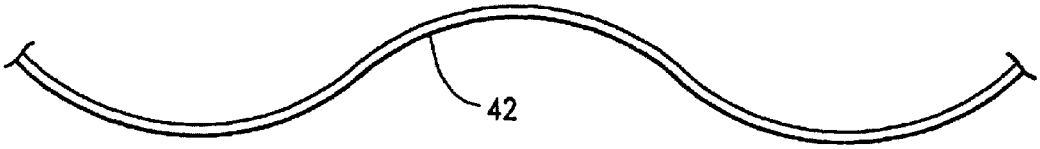
FIG. 15 is an end view of a portion of the standing seam assembly of FIG. 6, showing a scalloping condition as a result of not pre-crimping the hook portion of the female sidelap portion.
Figure 16:
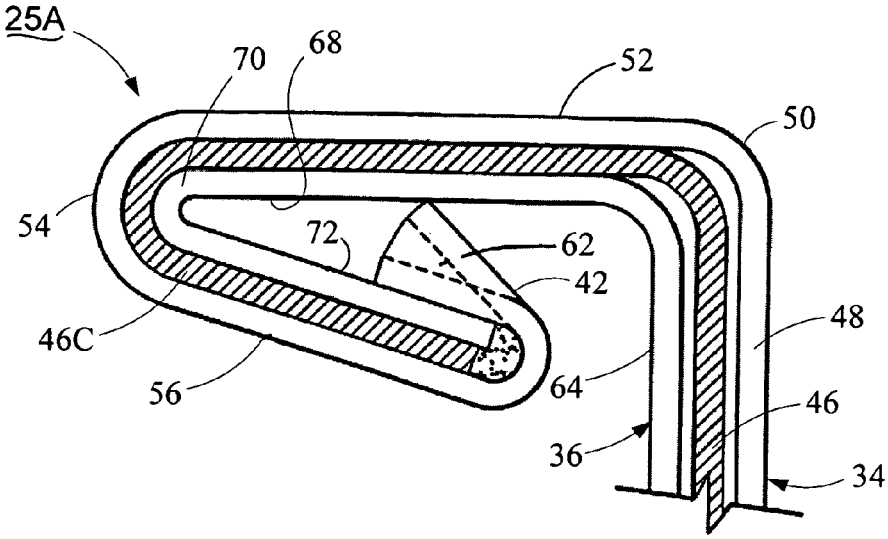
FIG. 16 is an end view of a portion of the standing seam assembly of FIG. 6, showing the scalloping condition of FIG. 14.
Figure 17:
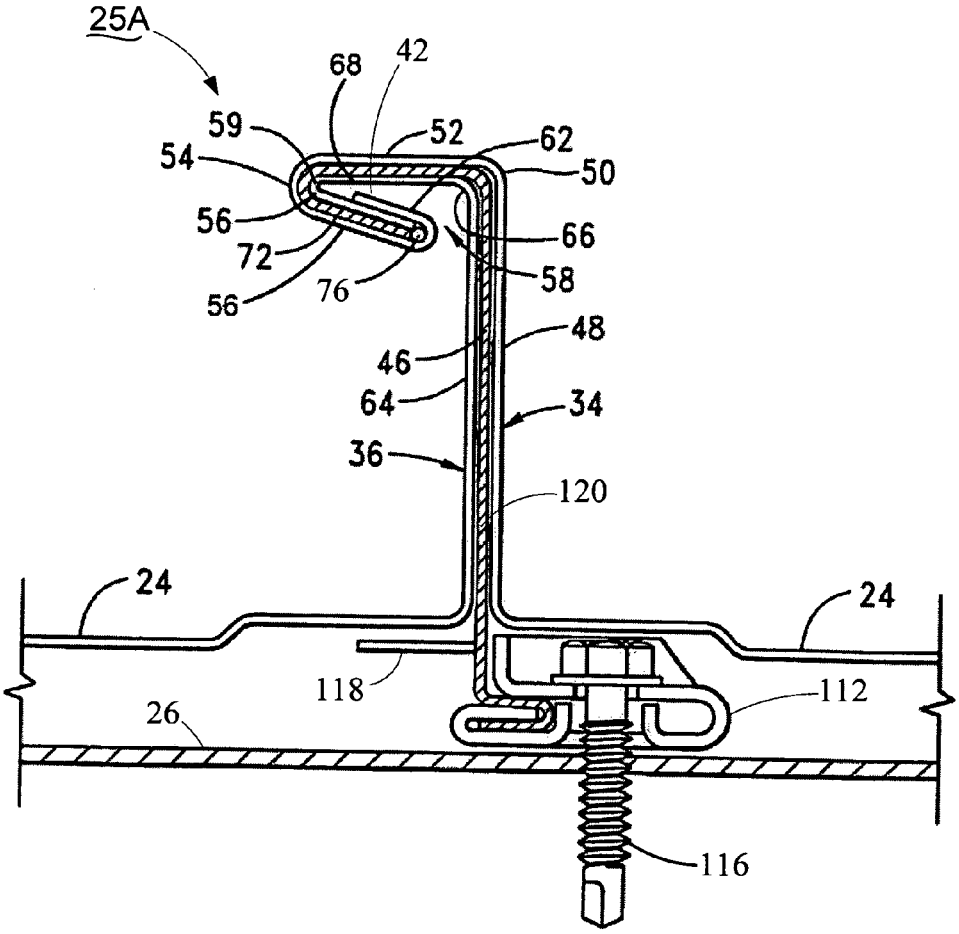
FIG. 17 is an elevational view of a standing seam assembly of FIG. 6 after field forming and attachment to the underlying roof structure.

In the seaming operation it is necessary to prevent the edge of the hook 42 of the female sidelap 34 from distorting in a manner that creates a scalloped edge, such as that shown in FIGS. 15 through 17. Such a scallop increases the effective width of the seamed joint which, if too wide, will interfere with the forming of the desired included angle of the female second radius portion 54 (FIG. 17) because the scalloped edge of the hook 42 (of female fourth leg member 62) will contact the male second leg member 68 (of male sidelap 36) as depicted in FIG. 16.

To prevent the scalloped edges and interference it is possible to pre-crimp the hook 42 against the male tang member 72 before forming the desired included angle within the female second radius portion 54. While FIG. 17 shows the standing seam 25A in its final seamed position and attached to the underlying panel support assembly 26, it will be understood that the angular disposition of the legs 52, 56, 62 (of the female sidelap 34), the legs 68 and locking tang 72 (of the male sidelap 36) and the corresponding legs of the clip 46 can be angularly determined during the seaming process as desired and can be angularly disposed such as that depicted in FIG. 9.

Figure 18:
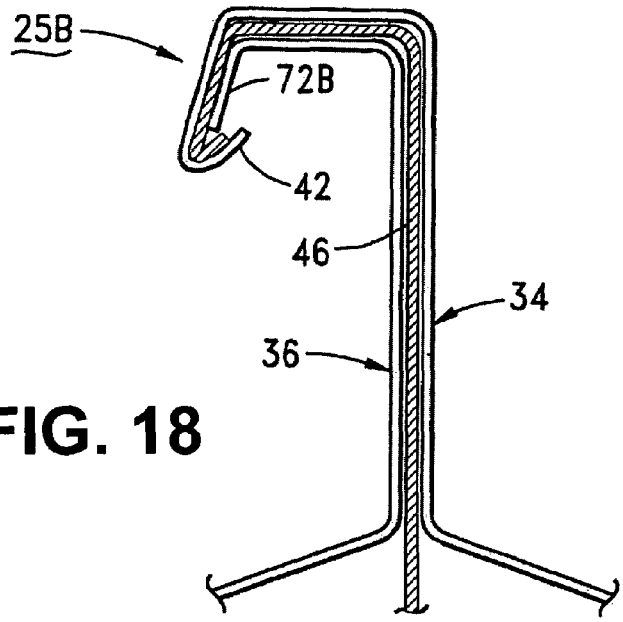
FIG. 18 is an elevational view of the standing seam assembly of FIG. 8 and FIG. 9 before the field seaming operation is performed.

Similarly, FIG. 18 shows the standing seam 25B (FIG. 8) in an unseamed position, whereby both the hook 42 of the female sidelap 34B and the hook portion of the roof clip 46 deflectingly pass the male tang member 72B of the male sidelap 36B, in order to wrap around the male tang member 72B after seaming.

Figure 19:
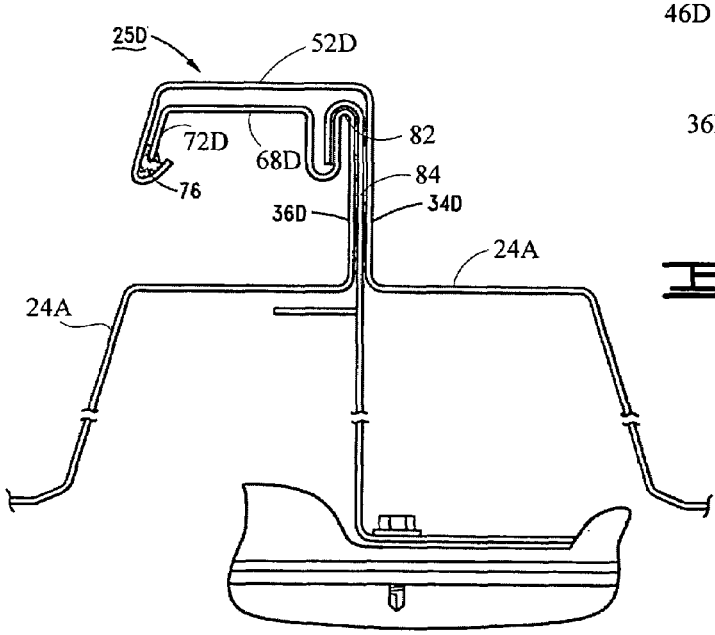
FIG. 19 is an elevational view of the standing seam assembly of FIG. 10 before the field seaming operation is performed.
Figure 19A:
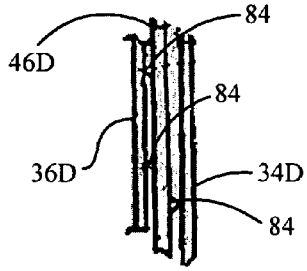
FIG. 19A is an enlarged portion of the standing seam assembly of FIG. 19.

FIG. 19 similarly shows the standing seam 25D (FIG. 10) in an unseamed mode with the serrations 84 relocated, as shown in FIG. 19A wherein the clip tab 46 has the serrations 84 engaging both male sidelap 36D and female sidelap 34D to prevent relative in plane movement between the two.

Figure 20:
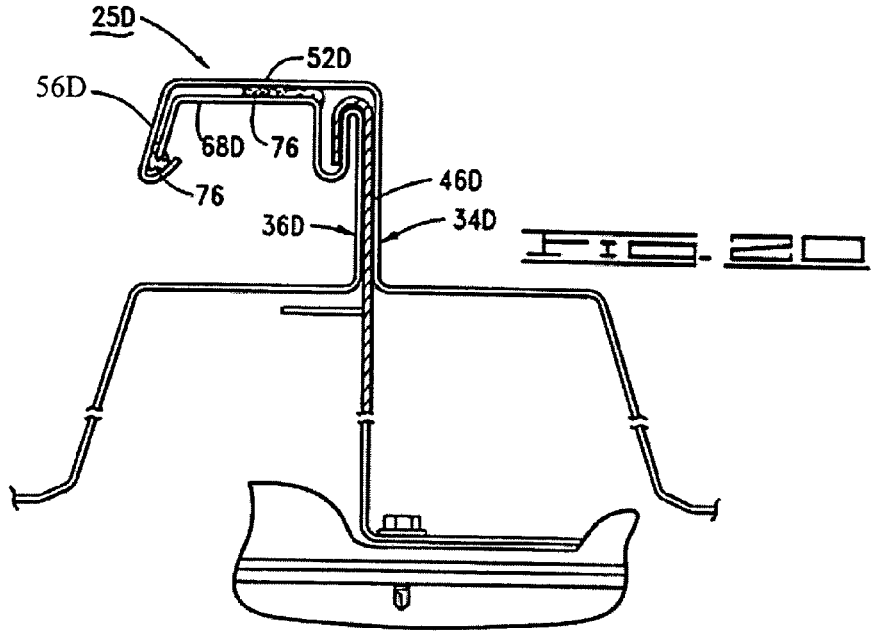
FIG. 20 is an elevational view of an alternative embodiment of the seam of FIG. 10 before the field seaming operation is performed.

FIG. 20 shows a modification to the standing seam 25D wherein the mastic sealant 76 is provided in two places, both at the distal ends where the female sidelap 34D and the male sidelap 36D are crimped together, and between the female second leg member 52D and the male second leg member 68D.

Figure 21:
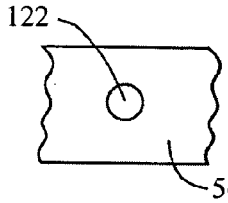
FIG. 21 is an elevational view of a portion of the female sidelap portion showing an alternative embodiment of the standing seam assembly of FIG. 19 wherein the female sidelap portion and the male sidelap portions are staked together to prevent sliding of one panel relative to the other.
Figure 22:
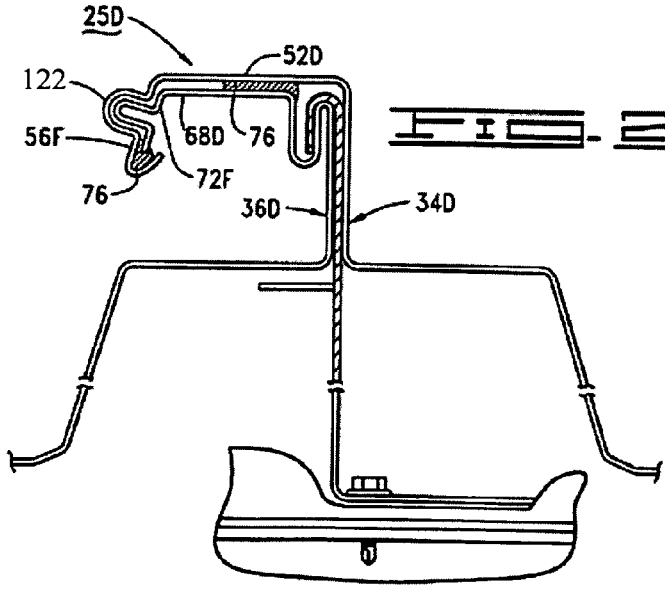
FIG. 22 is an end view of the staking operation of FIG. 21.

FIGS. 21 and 22 show modifications wherein the female third leg member 56F of the female sidelap 34F and the male tang member 72F of the male sidelap 36F are mechanically staked together by an upset crimp 122 to prevent relative in-plane longitudinal shear movement between adjacent panels.

Figure 23:
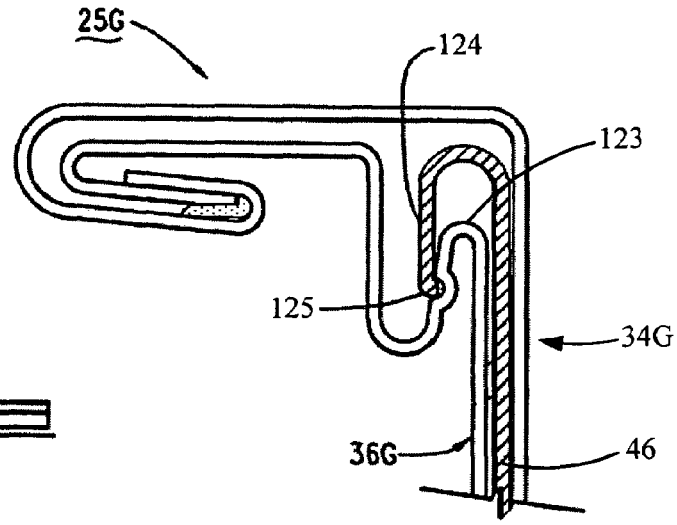
FIG. 23 is an elevational view of an alternative preferred embodiment of the standing seam assembly of FIG. 10.

FIG. 23 shows an improvement to the standing seam 25G (FIG. 10) wherein the male sidelap 36G forms a wedge-shaped portion 123 that is disposed inside hook 124 of the roof clip 46. Uplift forces cause the male sidelap 36G to rise and to rotate clockwise and the female sidelap 34G to rotate counter-clockwise, thereby wedging the wedge-shaped portion 118 into the cavity of the hook 120. At a selected amount of wedging displacement a notch 125 is engaged by the leading edge of the hook 124 and that mechanically locks the two together to enhance the lockability and to ensure that the roof clip 46 does not disengage the male sidelap 36G.

Figure 24:
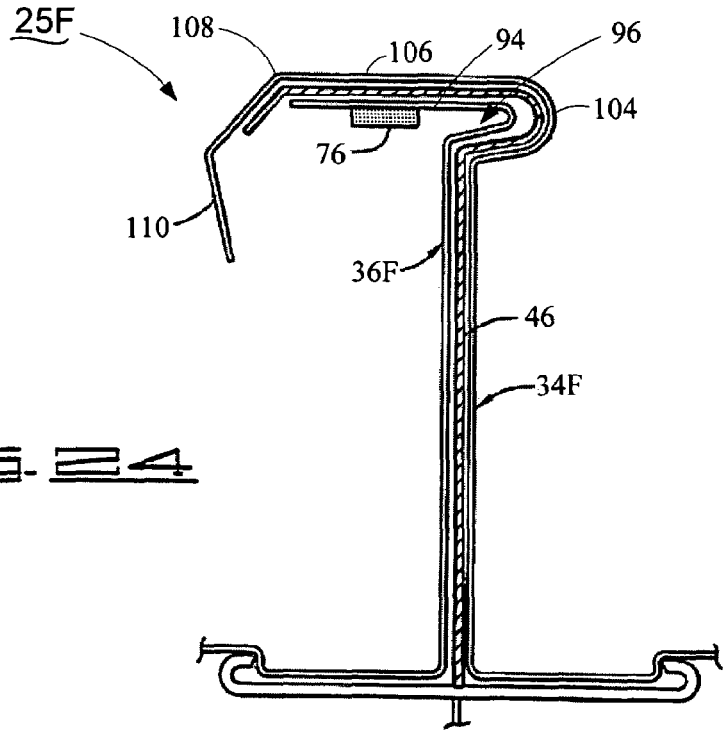
FIG. 24 is an elevational view of the standing seam assembly of FIG. 13 prior to the field seaming operation.
Figure 25:
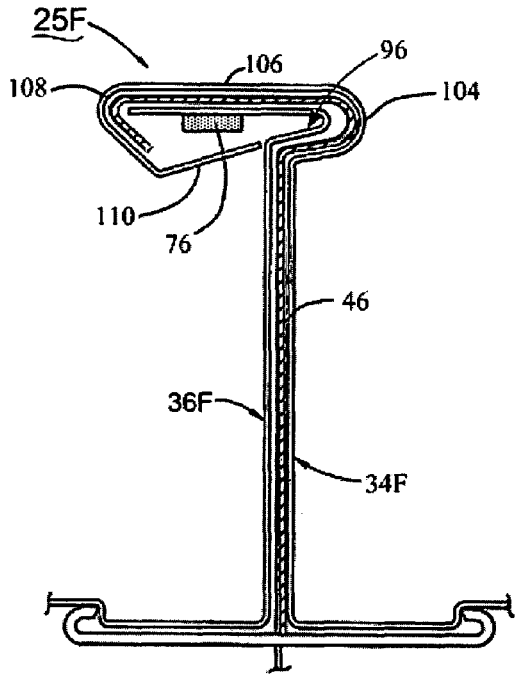
FIG. 25 is an elevational view of the standing seam assembly of FIG. 13 at an intermediate configuration during the field seaming operation.

FIG. 24 shows the standing seam 25F of FIG. 13 in an unseamed mode. The seaming operation rotates the female tang member 110 counter-clockwise and urges it and the end of the roof clip 46 around the end of the male sidelap 36F as shown in FIG. 25, with the end of the female tang member 110 receivingly engaged in the retaining groove 96 in the final seamed mode.

Figure 26:
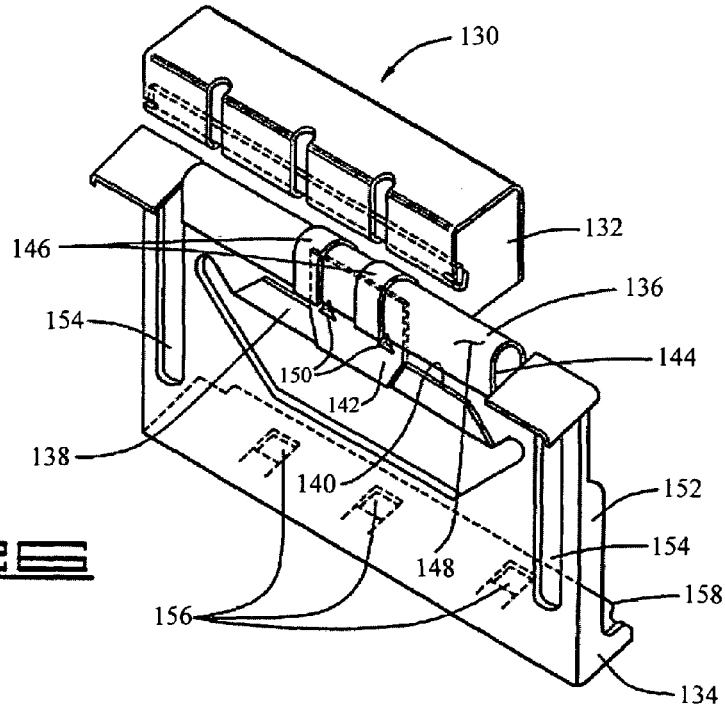
FIG. 26 is an isometric view of a two-piece roof clip assembly.
Figure 26:
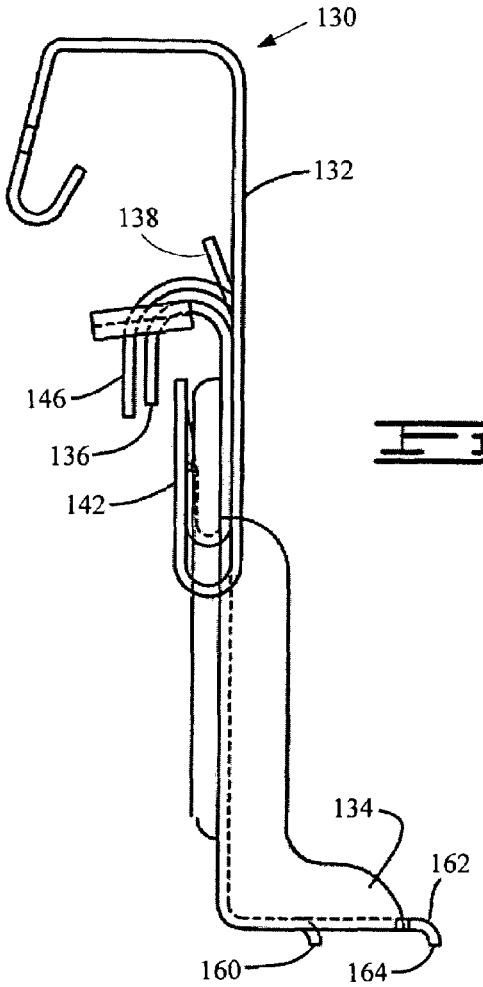

FIG. 26 shows an alternative two-piece roof clip 130, which has a hold down clip tab 132 as well as a clip base 134 to which the hold down clip 132 is attached. The clip base 134 has a beam section 136 and an upwardly pointing flange portion 138 having a top flange surface 140. The beam section 136 and flange portion 138 slidingly support the hold down clip tab 132 to limit vertical movement thereof, and to provide for longitudinal movement of the hold down clip tab 132 relative to the clip base 134 along the beam section 136. More particularly, the hold down clip tab 132 has a first tab member 142 that slidingly engages an inside surface 144 of the beam section 136, and a pair of second tab members 146 that slidingly engage an opposing outer surface 148. A pair of third tab members 150 extend from the first tab member 142 and slidingly engage the top flange surface 140. In this manner, the top flange surface 140 provides a track on which the hold down clip 132 slides in a longitudinal direction.

Figure 27:
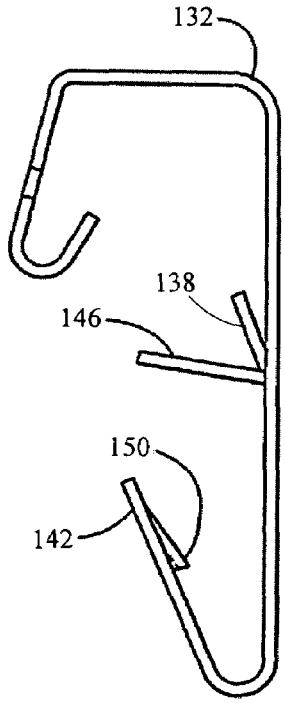
FIG. 27 is an end view of the hold down clip portion of the two-piece clip assembly of FIG. 26.
Figure 29:
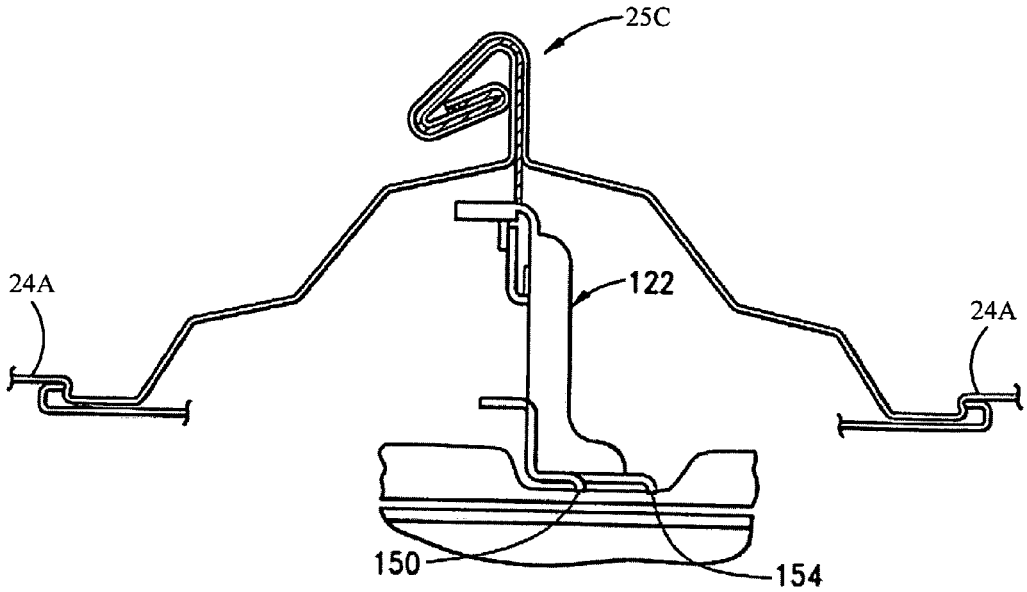
FIG. 29 is an elevational view of the roof system of the present invention, employing the roof members of FIG. 4 attached to the underlying roof structure by the two-piece roof clip of FIG. 26.

FIG. 27 shows the hold down clip 132 before being installed to the clip base 134, which is accomplished by inserting the first tab member 142 and the second tabs 146 around the beam section 136 of the clip base 134. The first tab member 142 is formed upward and its end placed inside the beam section 136. The second tabs 146 are formed downward to engage the beam section 136 in opposition to the first tab member 142. FIG. 29 shows the hold down clip tab 132 installed in this manner on the clip base 134.

The clip base 134 can be formed from a single piece of sheet metal formed as shown so as to include rib sections 152 and embossments 154 to provide additional strength and resistance to distortional forces upon the clip base 134.

The clip base 134 is anchored to the underlying structure, such as a purlin, as depicted in FIG. 29, by conventional fasteners (not shown). More particularly, the fasteners are placed through openings 156 (FIG. 26) in a bottom facing flange 158 of the clip base 134. To provide a solid connection of the base over thermal insulation above the purlin, the flange 158 is formed with feet 160 that extend downwardly at an angle substantially normal to the flange 158 and which thereby easily compress the thermal insulation so as to bear solidly on the purlin. The feet 160 are formed by punching rectangular holes or openings through the flange 158 and forming the metal of the openings downward. Additionally, a back edge 162 of the flange 158 is formed downwardly to provide a foot 164 that acts in cooperation with the feet 160 to support the flange 158.

Finally, FIG. 29 shows the standing seam 25C formed of adjacent panels 24A having trapezoidal sidelap portions and secured to the underlying roof structure with the two-piece roof clip 130 of FIG. 26. It will be noted that all of the exemplary configurations of the standing seam 25 discussed herein above can be used with either flat pan or trapezoidal sidelap portions, and with either the one-piece roof clip 46 or the two-piece roof clip 122.

FIGS. 30-37

Having discussed several embodiments of the standing seam 25, as well as alternative sidelap portion configurations and roof clip configurations, attention will now be directed to a novel method of seaming the standing seam 25 during field installation of a standing seam roof.

As discussed above, the standing seam 25 requires a pre-crimping operation of the hook 42 of the female sidelap 34 prior to jointly forming the male tang member 72 of the male sidelap 36 and the female third leg member 56 of the female sidelap 34 to the desired angle at the female first radius portion 50 and female second radius portion 54. This prevents scalloping of the edge of the hook 42 as discussed above and shown in FIG. 16.

Figure 30:
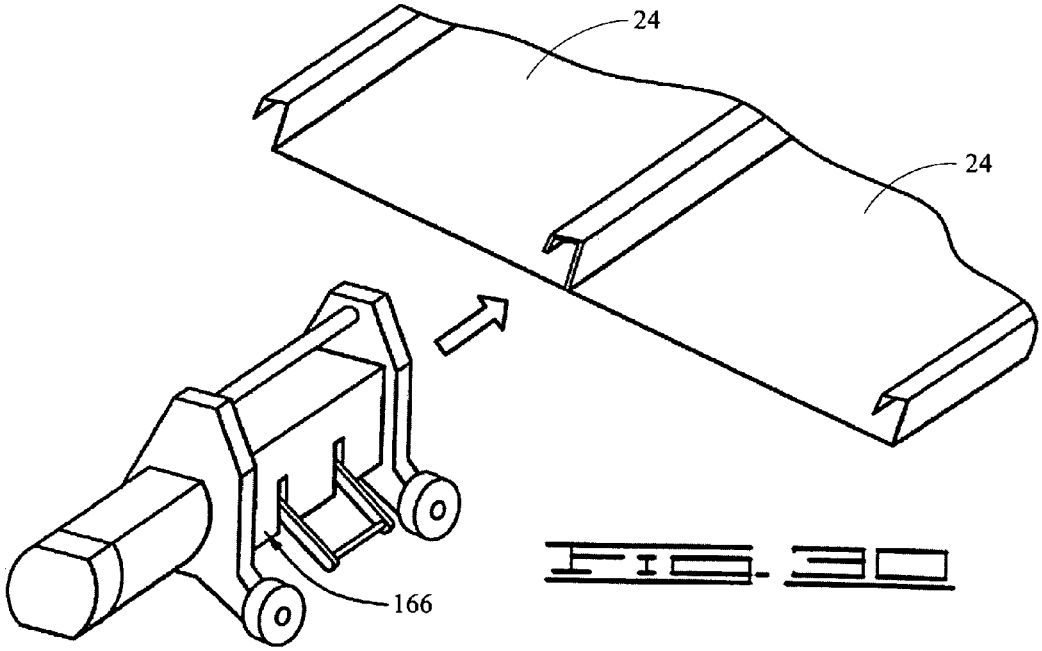
FIG. 30 is a diagrammatic view of a conventional seaming machine.
Figure 31:
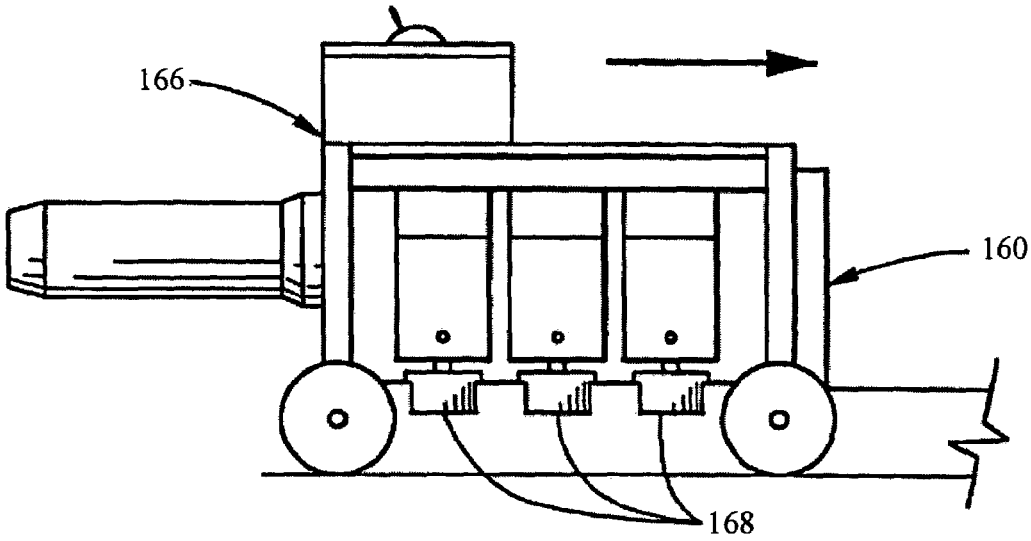
FIG. 31 is a side view of the seaming machine of FIG. 30 with a pre-crimping attachment constructed in accordance with the present invention.
Figure 32:
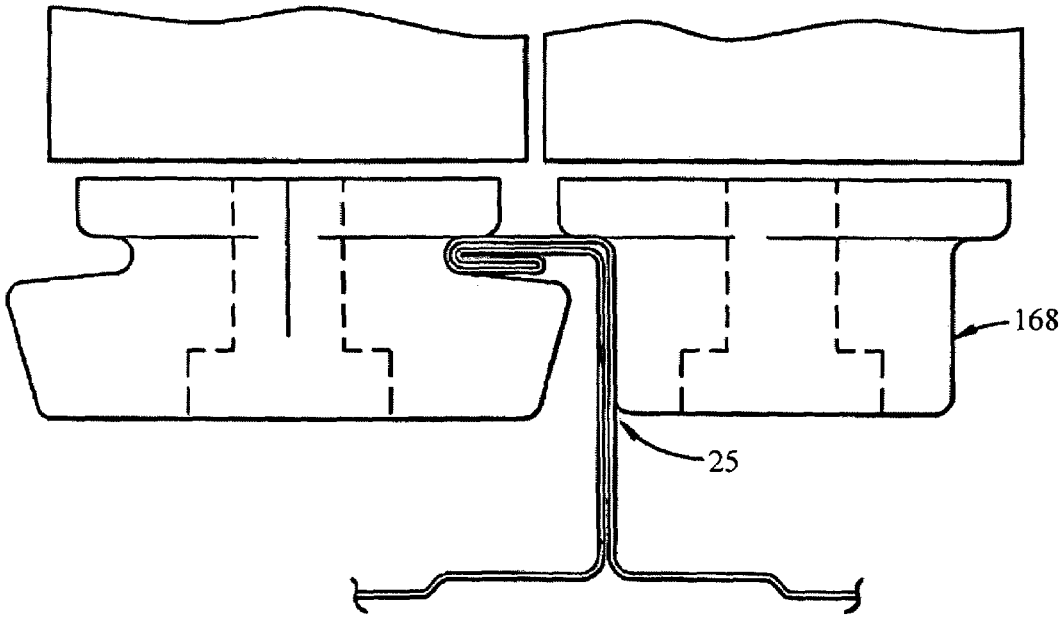
FIG. 32 is an elevational view of one of the roller sets of the seaming machine of FIG. 30 in seaming engagement with a standing seam assembly of the present invention.
Figure 33:
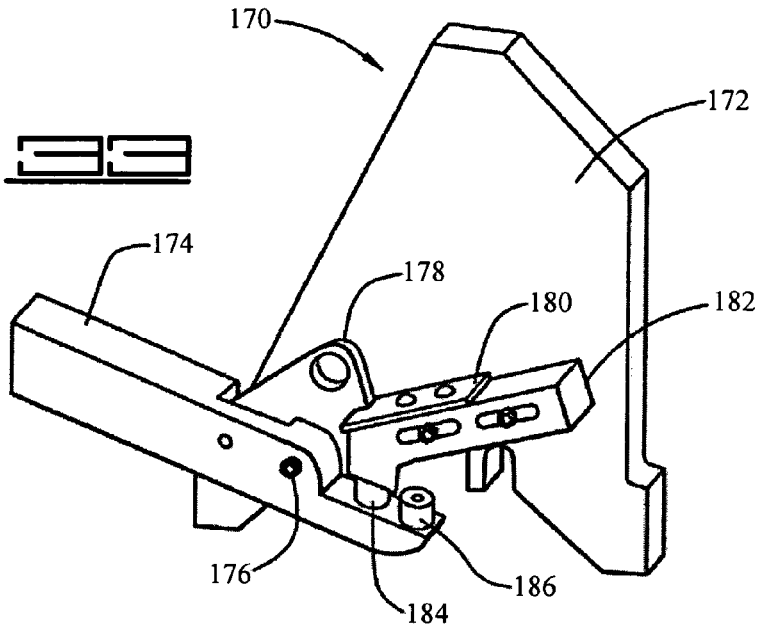
FIG. 33 is an isometric view of a pre-crimping assembly attachment for use with the seaming machine of FIG. 30.

FIG. 30 shows a conventional seamer apparatus 166 that is widely used in the art to perform seaming operations on standing seam roofs. FIG. 31 is a side view of the seamer 166, which typically employs a series of rollers 168, usually three sets, to progressively form the standing seam with the pre-crimper attached to the front plate. FIG. 33 shows one set of the opposing rollers 168 in crimping engagement with the standing seam 25. However, the seamer apparatus 166 is not in of itself adequate to seam the standing seam 25 to completion as required herein.

One method of adding the needed pre-forming operation to the seamer 166 shown in FIG. 31 is to add another set of rollers configured to crimp the standing seam 25, but to do so would require a relatively expensive modification in order to extend the chassis and gear mechanisms. An alternative approach is to provide a bolt-on attachment supporting an additional set of pre-crimping rollers to the front of the existing chassis of the seamer 166.

FIG. 33 shows a pre-crimping assembly 170 that is attachable to the seamer 166 for use on a standing seam roof having flat pan sidelap portions, such as a roof constructed with the panel 24 shown in FIG. 3. The pre-crimping assembly 170 has a support plate 172 that is a part of the conventional prior art seamer and which supports a handle 174 that pivots about an eccentric bushing 176 depending from the support plate 172, a latch 178 pinned to the handle and lockingly engageable with a latch plate 180, and a roller bracket 182 supported by the support plate 172 and supporting, in turn, the latch plate 180. The roller bracket 182 supports a first cam roller 184, and the handle 174 supports an opposing second cam roller 186.

Figure 34:
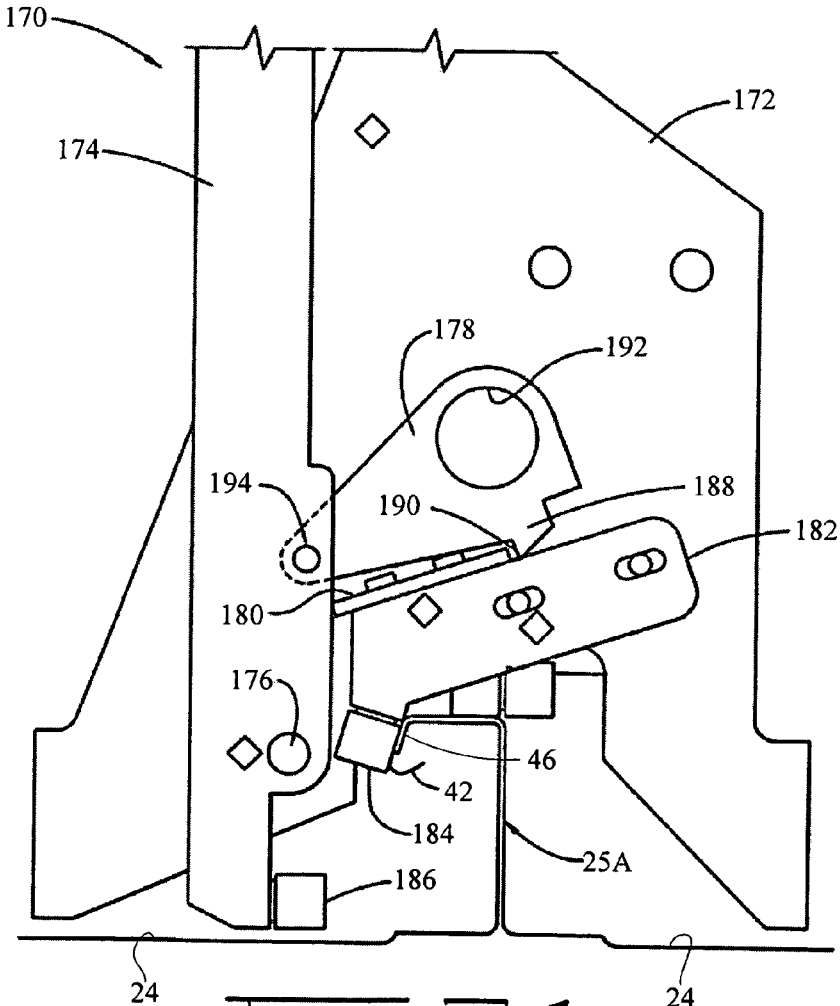
FIG. 34 is an elevational view of the pre-crimping assembly of FIG. 33 for use on the standing seam assembly of FIG. 3, the pre-crimping assembly shown in an open mode.
Figure 35:
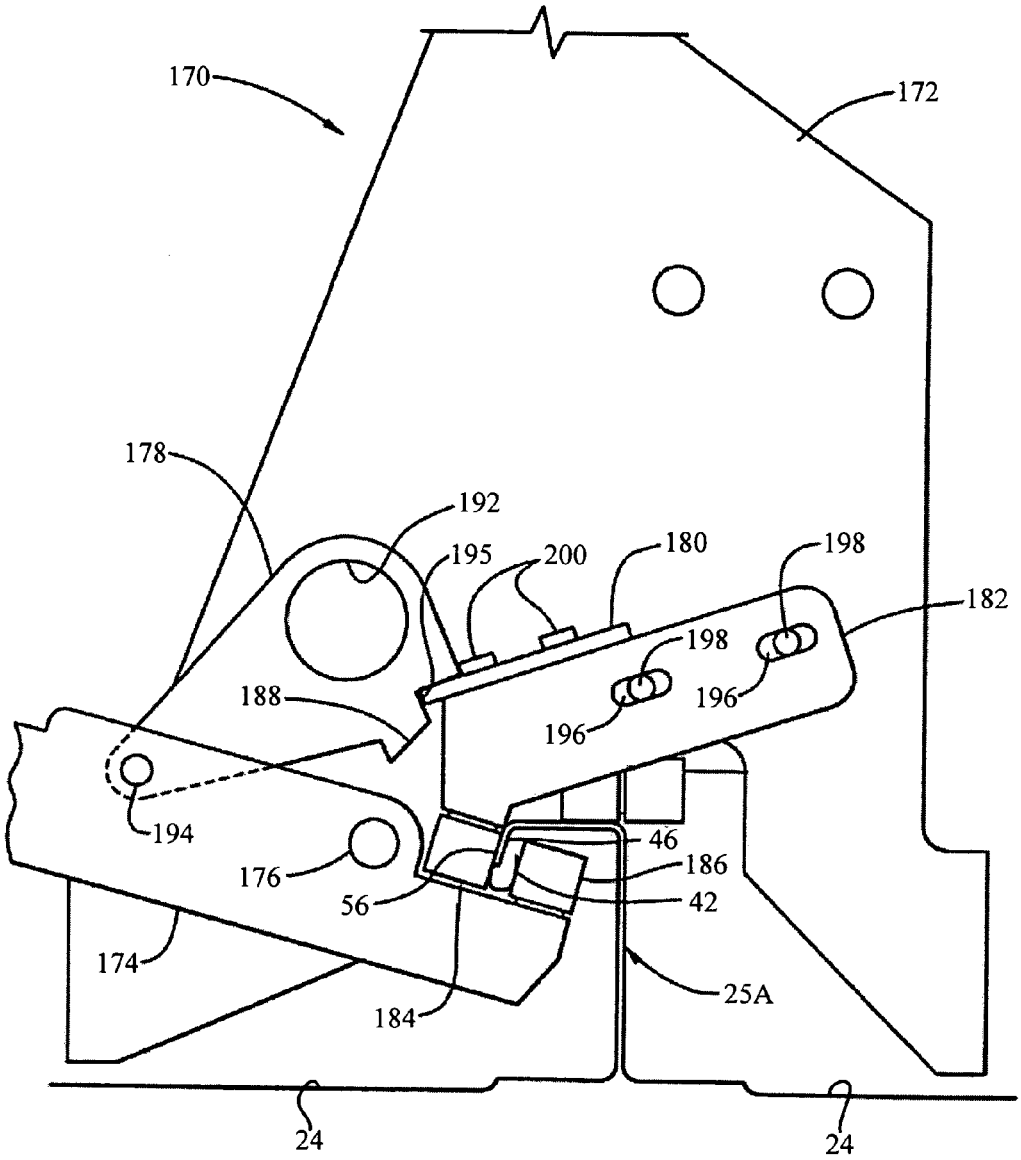
FIG. 35 is an elevational view of the pre-crimping assembly of FIG. 33 for use on the standing seam assembly of FIG. 3, the pre-crimping assembly shown in a closed mode.

FIG. 34 shows the pre-crimping assembly 170 operably positioned adjacent a standing seam 25 in an open position, whereby the latch 178 has a locking gear 188 having a surface 190 abuttingly engaging the latch plate 180 to maintain a substantially vertical position of the handle 174 and thus retraction of the second cam roller 186 from the standing seam 25. The latch 178 has a finger hole 192 to facilitate the lifting thereof about a pin 194 supported by the handle 174, thereby disengaging the locking gear 188 from the latch plate 180. This allows the handle 174 to rotate about the eccentric bushing 176 to position the second cam roller 186 into operable engagement with the hook 42 of the female sidelap 34, as in FIG. 35, which shows the pre-crimping assembly 170 in its closed position. The handle 174 is maintained in the closed position by the pressing engagement of a surface 195 of the locking gear 188 against the latch plate 180.

In use, the seamer 166 with the pre-crimping assembly 170 mounted thereon is placed in the open position and positioned adjacent the standing seam 25 that is to be field seamed. The roller bracket 182 is adjustably positionable by a slot 196 and threaded fastener 198 arrangement. The roller bracket 182 is thus positioned so that the first cam roller 184 touches the female third leg member 56 of the female sidelap 34. The latch 178 is then raised and the handle 174 is lowered to place the second cam roller 186 parallel to the first cam roller 184, and spaced approximately 5/32 inch there from. The latch plate 180 has a slot (not shown) and threaded fastener 200 arrangement, like the roller bracket 182 attachment to the support plate 172. The latch plate 180 is thus adjusted to provide a locking engagement with the locking gear 188 of the latch 178 to maintain the desired position of the second cam roller 186.

Figure 36:
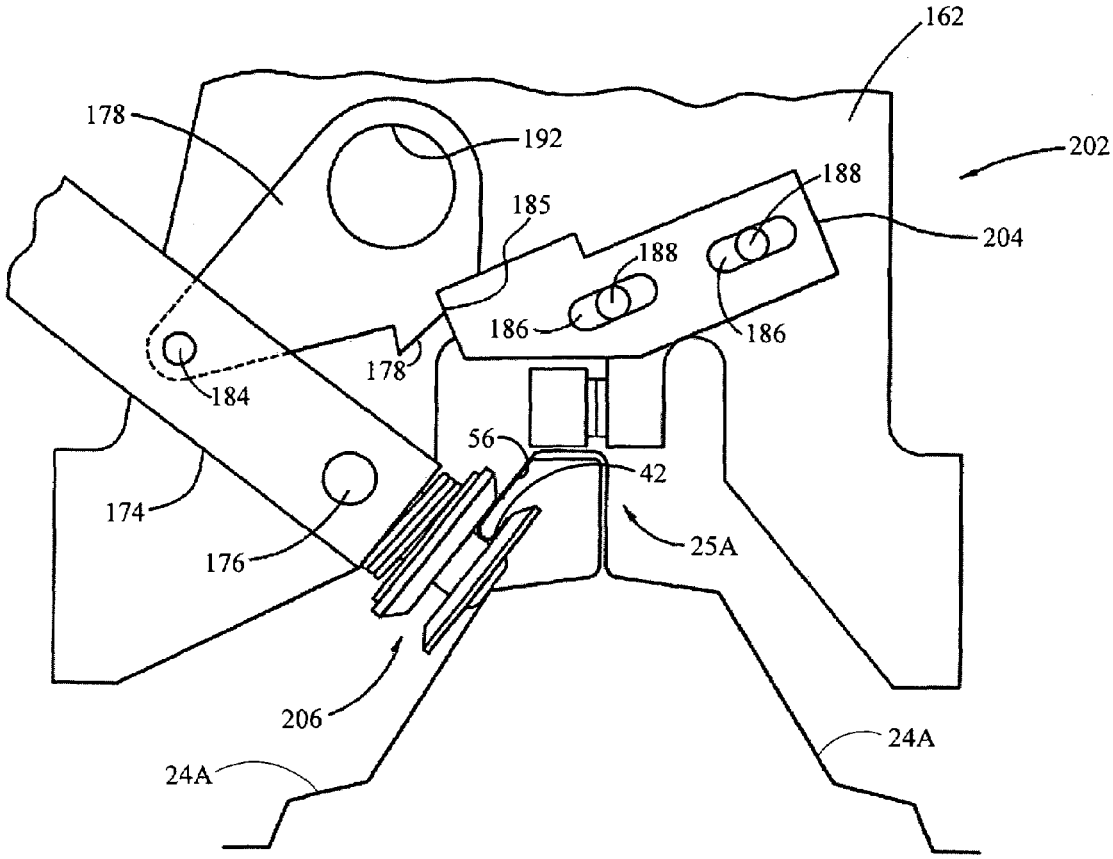
FIG. 36 is an elevational view of a pre-crimping assembly for use on the standing seam assembly of FIG. 4, the pre-crimping assembly shown in a closed mode.

FIG. 36 shows a pre-crimping assembly 202 for use on standing seam roof panels having trapezoidal sidelap portions, such as the panel 24A of FIG. 4. The pre-crimping assembly 202 has several of the same components as the previously described pre-crimping assembly 170, namely the support plate 172 which supports a handle 174 about an eccentric bushing 176, and a latch 178 pinned to the handle 174, the latch 178 having a locking gear 188. Furthermore a latch plate 204 supports the latch 178 in a desired position. The handle 174 supports a crimping roller assembly 206, which is shown in exploded detail in FIG. 37.

Figure 37:
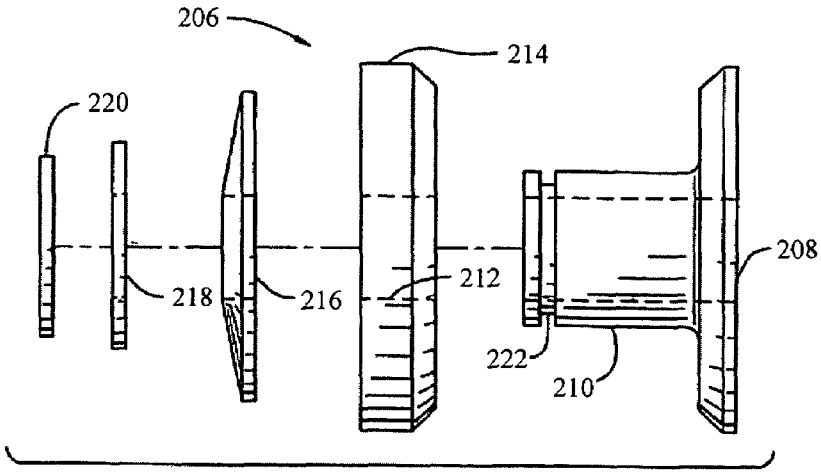
FIG. 37 is an exploded view of the crimping roller assembly of the pre-crimping assembly of FIG. 36.

FIG. 37 shows a bottom roller 208 having a shaft portion 210 which engages a bore 212 of a top roller 214. One or more spring washers 216, such as a Belleville type, and a flat washer 218 are stacked on the shaft 210 and against the top roller 214. If more than one spring washer 216 is used, the spring washers 216 can be stacked parallel or opposite to each other to achieve the desire position and spring compression. A circle clip 220 engages a groove 222 in the shaft 210 to retain the components of the crimping roller assembly 206.

In use, the crimping roller assembly 206 is similarly set up as the pre-crimping assembly 170 discussed previously. By lifting the latch 178 the handle 174 can be lowered to bring die crimping roller assembly 206 into operable engagement with the standing seam 25. The eccentric bushing 176 is rotated to align the roller flanges with the seam. The latch plate 204 is adjusted to place the roller assembly 206 to the proper depth of engagement with the seam 25, and the pre-crimping assembly 206 is then moved along the seam 25 to achieve the desired field seaming.

In the above discussions the merits of a standing seam roof with few or no fasteners penetrating the sheet metal panels at medial portions thereof has been recognized. Generally, applications of standing seam roof panels with floating roof clips have capitalized on reducing the medial penetrations in order to minimize leak paths through the roof. At times, however, the lack of medial attachment of the panels to the underlying support structure can result in an undesirable reduction in diaphragm strength of the roof or wall, resulting in a need for additional bracing.

In order to achieve good diaphragm strength, the panels making up the roof or wall must possess a number of qualities. One such quality is resistance to one panel sliding in relation to an adjacent panel. This quality is referred to as in plane panel sidelap shear capacity. Such panel sidelap shear capacity, or resistance to sliding, can be achieved in a number of ways. A sufficient diaphragm strength is necessary to prevent the roof panels from "saw-toothing" when subjected to a lateral "racking" load.

Figure 38:
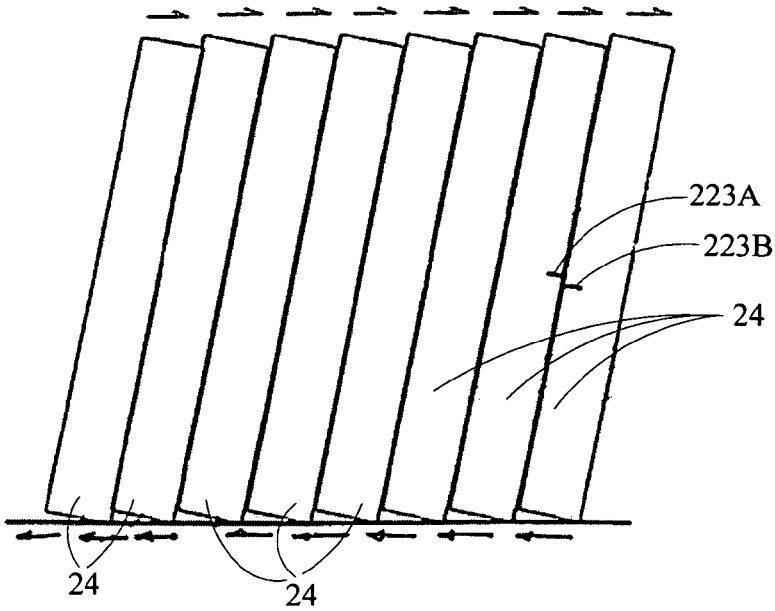
FIG. 38 is a diagrammatical representation showing one seamed configuration of adjacent roof panels of the present invention resisting when subjected to load.

This is illustrated in FIG. 38 in which is depicted a plurality of roof panels 24 having the seamed configuration of the present invention and that are resisting unfurling when subjected to uplift loading. That is, FIG. 38 represents a portion of adjacent panels such as metal roof or wall panels that are subjected to diaphragm loads that occur in the sidewall or roof of a metal building when wind load is applied to the building or in a floating standing seam roof supported by zee purlins, wherein as the roof is subjected to downward load the purlins tend to rotate in the direction of the compression flange and the diaphragm strength of the roof helps prevent such movement and stiffens the purlins between purlin to frame attachment points. The opposing force arrows (not separately designated) depict this diaphragm shearing load.

For the panels 24 to resist the diaphragm load, among other things, the panels must resist relative longitudinal movement, or sliding, of adjacent panels. To illustrate the shearing movement under such load, a pair of marks 223A and 223B are shown at the edges of the two panels at the right side of FIG. 38; under normal condition, prior to the implementation of the present invention, the marks 223A and 223B were aligned before the sideward movement of the panels 24. As depicted, without medial attachment of the panels 24 to the underlying support structure, the panels 24 are permitted to slidingly rotate as illustrated by the misalignment of the marks 223A and 223B. That illustrated in FIG. 38 is a lack of in plane panel sidelap shear capacity of the panels 24 as mounted. The present invention, once installed, provides an appropriate degree of panel sidelap shear capacity to the panels 24 and these panels will remain in the installed position so that the marks 223A and 223B remain aligned under diaphragm shearing load.

Figure 39:
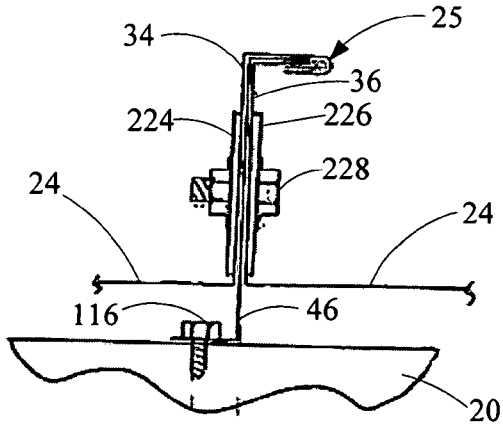
FIG. 39 is a diagrammatical representation showing one other seamed configuration of adjacent roof panels of the present invention resisting in plane shear movement when subjected to load.
Figure 40:
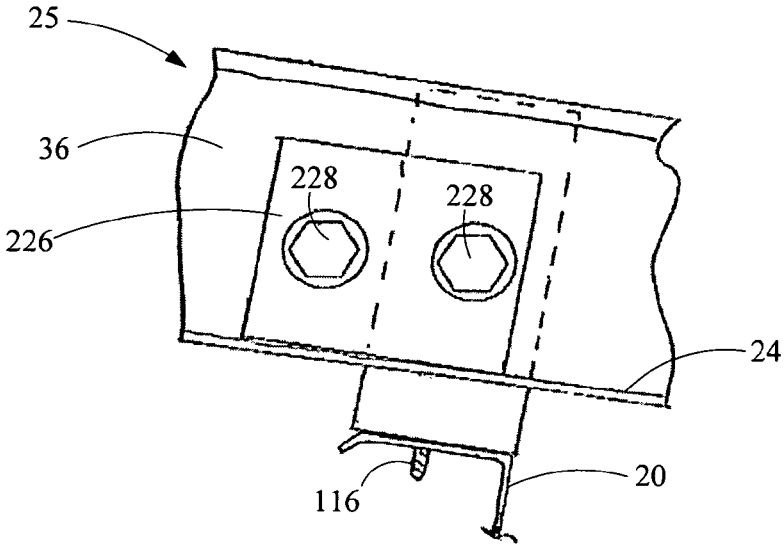
FIG. 40 is an elevational view of the standing seam assembly of FIG. 39.

One embodiment of the present invention to increase the diaphragm strength of a standing seam roof is to attach a backer plate on the upstanding portions of the sidelap portions, as illustrated in FIGS. 39 and 40. Shown therein is a backer or support plate 224 engaging the female sidelap 34 and a backer or support plate 226 engaging the male sidelap 36 of the standing seam 25 of interlocking adjacent roof panels 24 supported on the secondary structural system 20. One or more fasteners 228 (FIG. 40) connect the backer plates 224, 226 to compressingly sandwich the sidelap portions there between. The tightened fasteners 228 increase the frictional and shear resistance between the sidelap portions 34, 36 to prevent sliding movement there between.

Preferably, the backer plates 224, 226 are used in protected areas of the roof, such as the ridge of a building which is protected by ridge trim, so that the through fasteners 228 do not show and are not exposed to the weather elements.

Figure 41:
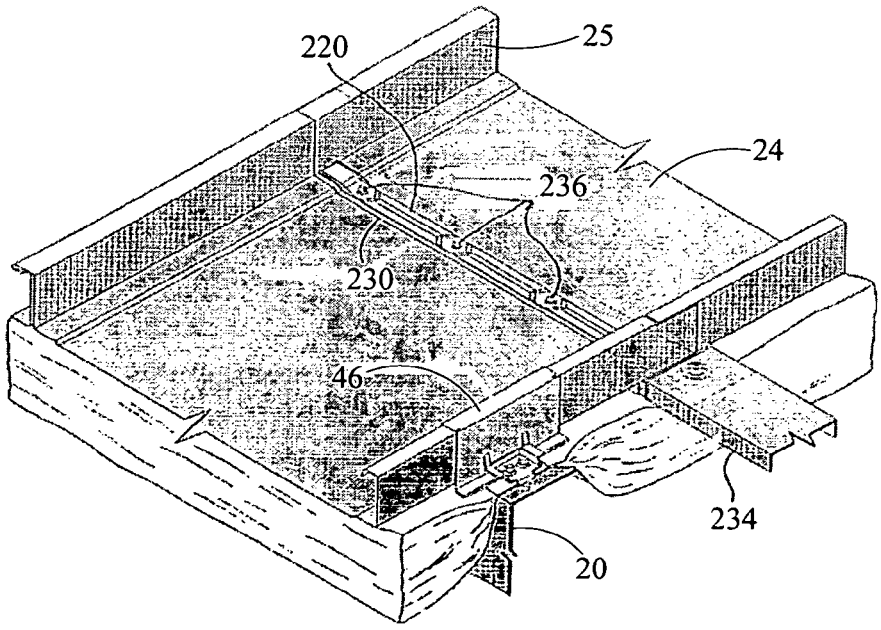
FIG. 41 is an isometric view of a standing seam roof assembly having a cinch plate and backer beam attached together at the endlap portion of the roof members to increase the diaphragm strength of the roof assembly.
Figure 42:
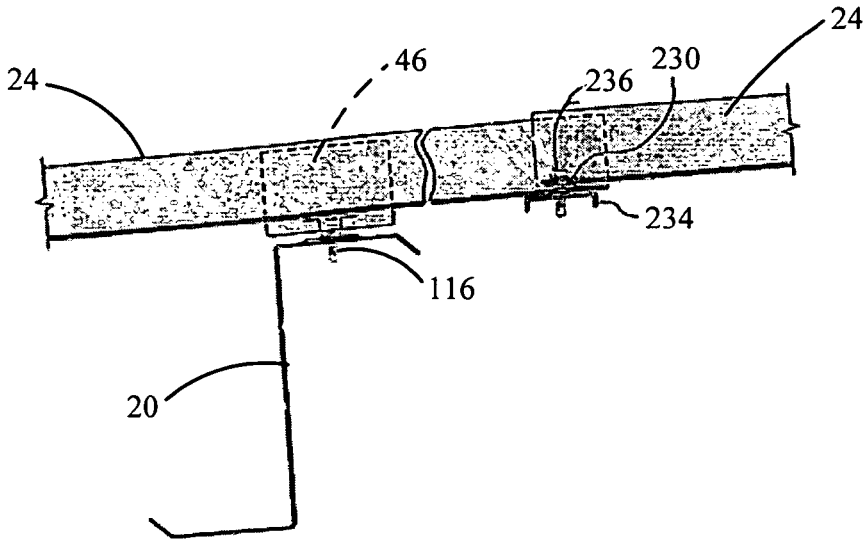
FIG. 42 is an end view of the standing seam roof assembly of FIG. 41.

Another embodiment of the present invention to increase the diaphragm strength of a standing seam roof is a backer and optional cinch plate securement at the panel endlap, ridge or eave locations. FIGS. 41 and 42 show an optional cinch plate 230 placed on top of a panel 24 which is in turn placed over a tape sealant 232 at the panel endlap location. A backer channel (or beam which may take numerous shapes) 234 is positioned under the cinch plate 230, and a number of fasteners 236 draw the cinch plate 230 and the backer channel 234 together. The backer channel 234 extends under and bridge between adjacent panels, which are similarly attached to the backer channel 234 via additional optional cinch plates 230 and fasteners 236. Thus, the multiple cinch plates 230 and fasteners 236 sandwich the panels 24 to the underlaying backer channel 234. The tightened fasteners 236 also increase the lateral resistance to sliding of end to end overlapped panels and the backer channel extending between adjacent panels.

The tightened fasteners 236 increase the shear resistance between adjacent panels in the vicinity of the endlap portions of the roof panels to prevent sliding between adjacent panels. The beam strength of the backer channel 234 serves to prevent adjacent panels from sliding in relation to each other. FIG. 42 shows an end view of the cinch plate 230 and backer channel 234 of FIG. 41. As noted above, a similar bridging arrangement between adjacent panels to prevent relative sidelap movement was discussed with reference to FIGS. 39 and 40 for a roof ridge condition.

Another way of increasing the diaphragm strength of the panels 24, often in combination with the other ways disclosed herein, is to utilize fasteners 236 to secure the eave row as shown in FIG. 2. That is, the fasteners 236 depicted in FIG. 2 firmly attach the ends of the panels 24 directly to the eave (the top of the wall member 32), or to a support member (not numbered) that is itself fastened to the eave.

Figure 43:
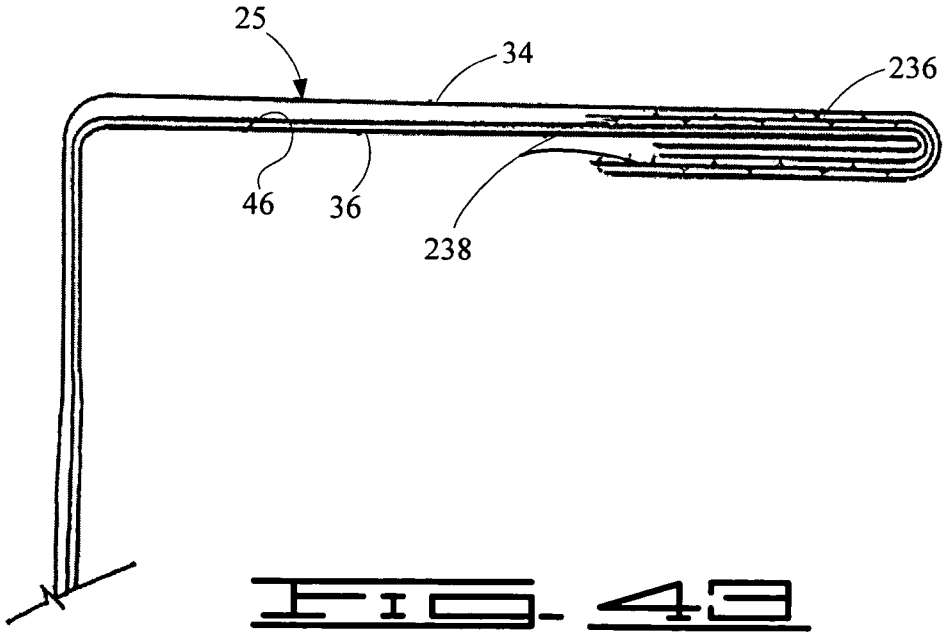
FIG. 43 is an end view of a standing seam assembly having a serrated plate seamed between the male sidelap portion and the female sidelap portion to increase the diaphragm strength of the standing seam roof assembly.

FIG. 43 shows yet another way of increasing the diaphragm strength of the panels at the standing seam 25 is by using serrated plates 237 (see also clip 46D in FIG. 10) at intervals along the seam. Each serrated plate 237 (or clip 46D) is placed between the male and female sidelaps and optionally seamed such as with seamer 166 (FIG. 30). Each plate 237 has plurality of protruding teeth 238 that engage both the male and female sidelaps to grippingly retain these members so as to prevent sliding movement there between. The serrated plate 237 may be used at a clip or at points between clips.

Figure 44:
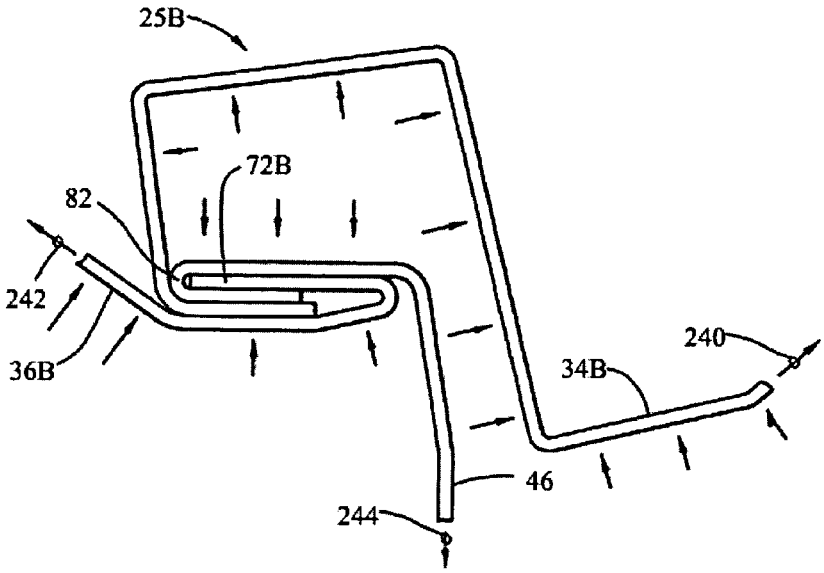
FIG. 44 is an elevational view of the standing seam assembly of FIG. 8 illustrating the standing seam assembly subjected to applied load forces.

FIG. 44 illustrates the manner in which the seamed configuration of adjacent roof panels of a roof of the present invention resist unfurling or unzipping when subjected to uplift loading. As depicted in FIG. 44, uplift forces tend to lift and rotate the roof panels this is resisted by the standing seam 25B (FIG. 8). The lifting and rotating force on the female sidelap 34B is along the directional arrow 240. The lifting and rotating force on the male sidelap 36B is along the directional arrow 242. A downward force in the direction of arrow 244 is exerted by the roof clip 46 resulting in the secure attachment of the standing seam 25B to the underlying support structure.

The amount of deflection illustrated by the uplift forces in FIG. 44 is dramatic and certainly beyond the elastic limit of the panels. Even so, the standing seam integrity is maintained so that the adjacent panel seams do not unfurl or unzip. It will be noted that the radius portion 82 of the roof clip 46 is lockingly engaged with the male tang member 72B so that the forces 240 and 242 will not separate the roof clip 46 from the male sidelap 36B. Further, it will be noted that the female sidelap 36B is lockingly engaged with the female sidelap 34B so that the forces 240 and 242 will not separate the sidelap portions.

Figure 45:
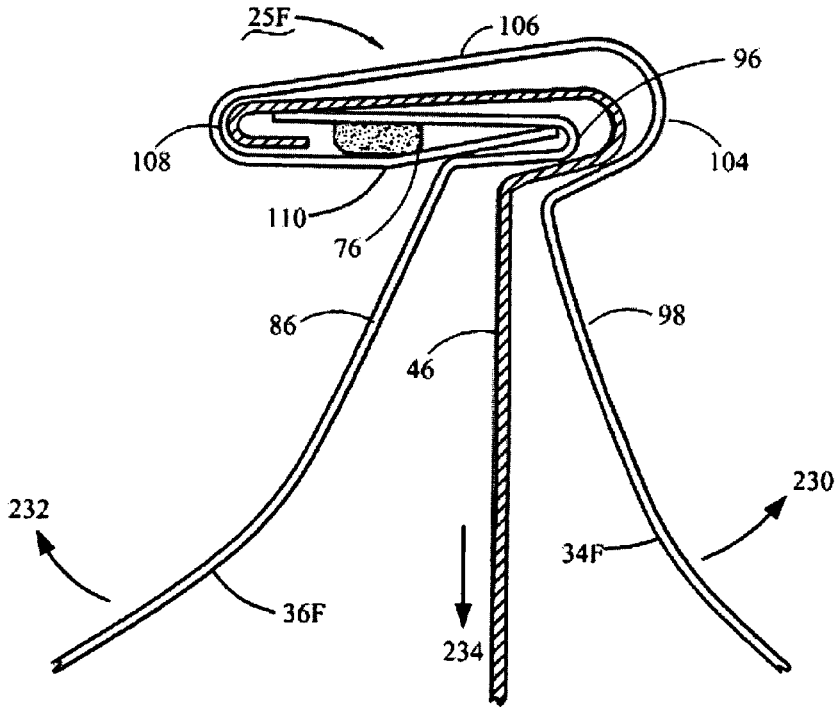
FIG. 45 is an elevational view of the standing seam assembly of FIG. 13 illustrating the standing seam assembly subjected to applied load forces.

It will be noted from FIG. 45 that the uplift forces 240, 242 that tend to lift and separate the male sidelap 36F and the female sidelap 34F of the standing seam 25F (FIG. 13) produce forces in the opposite direction on the tang member 110 and the retaining groove 96, so as to drive the tang member 110 ever more into the retaining groove 96. In this manner, the uplift forces 240, 242 do not succeed in unfurling the standing seam 25F.

Returning to FIGS. 10, 21-22 and 38-43, there are two principal reasons that the disclosed devices, purposed to increase the diaphragm strength of building roofs and walls, may not be accepted as readily as they could be. People often object to bolts, nuts and fasteners penetrating the roof panel from the outside because the fasteners may corrode, leak or impair aesthetics. When using the apparatus of FIGS. 39 and 40, 41 or 42, it is desirable to make the apparatus as attractive, functional, unobtrusive and inconspicuous as possible. However, changing product uses and functional requirements have increased the need for improved diaphragm strength and for this type device. One of these is that diaphragm strength has a direct impact on the structural strength of zee purlins used as support members for panels. Technical requirements relating to the stability of zee purlins are becoming much more rigorous, as is the stability of the overall structure. Diaphragm strength can contribute directly to both of these, and this mitigates the objections mentioned above.

In the embodiment of FIGS. 41 and 42, it is preferable that the outside fastener 236 on each side of the panel be located as close to the edge of the panels as practical to minimize buckling of the cinch strap, back-up plate or panels as the joint is subjected to shear load.

Aesthetics and functionality may be improved in the embodiment disclosed in FIGS. 39 and 40 by using a flat head bolt with the flat head of the bolt located and pressing against the surface of the female sidelap 34. The bolt head may be large enough to distribute the compressive load over an appropriate area and it may be applied in such a manner as to make it as inconspicuous as possible. The underside of the bolt head may be coated with an appropriate material to seal between the bolt head of fastener 228 and the surface of the female sidelap 34. The nut may be located under the projecting corrugation 25 which will, at least, partially hide the nut which can be made as inconspicuously as possible by finishing and forming it so that it is not obtrusive.

The bolt and nut of fastener 228 may be located as close as possible to upper flange 25 to hide it, and the nut also may be made watertight by the proper application of a sealant material between the nut and the exterior of the male sidelap 36. If the bolt extends through the nut, the sealant between the nut and the surface of the male sidelap 36 may be forced around the bolt threads by the pressure exerted by the bolt to form a watertight joint.

The nut may also take an alternate form, that of an "acorn" nut, which is one that covers over the end of the bolt so that there can be no leaking between the bolt threads and the nut threads from the outside end of the bolt. If an acorn nut is used, the bolt length must be coordinated with the thickness of the materials to be included in the bolt grip after the nut has been applied so the depth of the bolt does not penetrate into the full depth of the acorn nut. This will enable the nut and the bolt head to force the material between them together so as to form a watertight, structurally sound, aesthetically pleasing joint. The apparatus may be located at a panel clip, in between panel clips or it may be located periodically throughout the length of the panel corrugation at critical locations such as panel endlap splices, the ridge, eave or other locations.

The embodiment disclosed in FIGS. 39 and 40 may be used in conjunction with other panel devices such as the back-up plate and cinch strap shown in FIGS. 41 and 42 to achieve the necessary diaphragm strength. If the apparatus is used with a clip, the clip may be a floating or fixed clip and doing this may also have the beneficial effect of strengthening the panel to increase its resistance to wind uplift. The bolt and nut may be made of corrosion resistant material such as stainless steel to improve its functional performance and acceptability.

The embodiments disclosed in FIGS. 10, 21 and 22, 41 and 42 and 43, 39 and 40 may be used in a specific area of the buildings such as at particular roofing areas that are more likely to sustain diaphragm shear loading in order to meet the zoned diaphragm strength requirements as discussed in my U.S. patent application Ser. No. 09/775,480 filed Feb. 2, 2001, entitled ZONE BASED ROOFING SYSTEM.

In order to assemble the device shown in FIGS. 39 and 40, it is desirable to compress the material through which the bolt penetrates when using a bolt with an acorn nut. The reason for this is the grip of the fastener will be limited to a given range and this grip range may not be great enough to reach through the material to be fastened together if the material is not forced together prior to attempting to apply the acorn nut. The necessary compression can be achieved by applying pressure next to the pre-drilled hole previously formed to receive the bolt using tongs pliers or vice-grip type device similar to a large pair of specially formed pliers having enlarged jaw gripping surfaces. Of course, another device that can be used to increase the frictional resistance between adjacent panes and to increase their resistance to shear forces in adjacent panels, is that of a U-shaped member (not shown) that has slot into which the standing seam can be received, and the housing having threaded apertures so that threaded rods can be positioned to exert closing pressure on the adjoined panels. Since frictional resistance is normally proportional to applied pressure, the frictional resistance and resistance to shear movement between the two adjacent panels is increased. These pressure apparatuses can used in conjunction with the apparatus of FIG. 43 to increase the effectiveness.

It is important to note that when the embodiments of the present application are used to increase the diaphragm strength of a portion of a roof, the overlap of the back-up plate on two adjacent panels as shown in FIGS. 41 and 42 or the bolted device disclosed in FIGS. 39 and 40 should be used continuously at each joint between adjacent anchor points. Further, it is advisable that an anchor device be used intermittently such as at primary support points or at the end of the panel runs should be adequate to transfer the shear or diaphragm load from the roof panels to a supporting structure member, such as a rigid frame, capable of resisting the diaphragm or shear force developed in the roof or wall.

Figure 46:
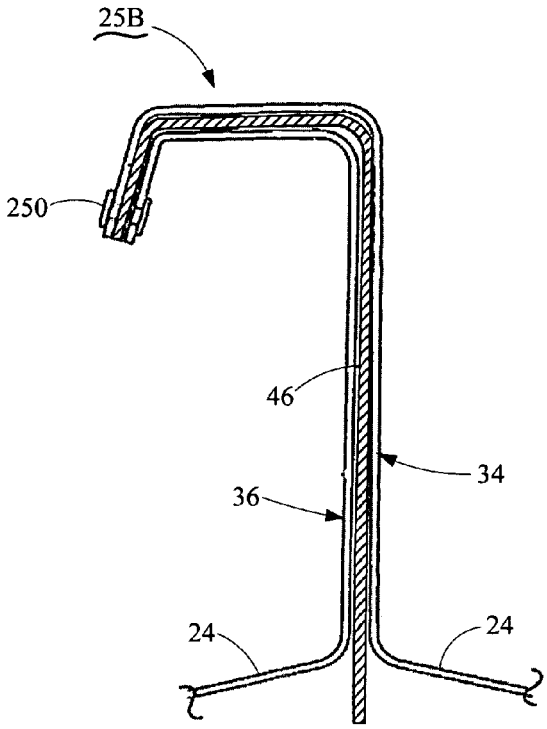
FIG. 46 is an end view of yet another alternative standing seam with a clip tab between the male and female corrugation with a fastener inserted through the male and female seam.
Figure 47:
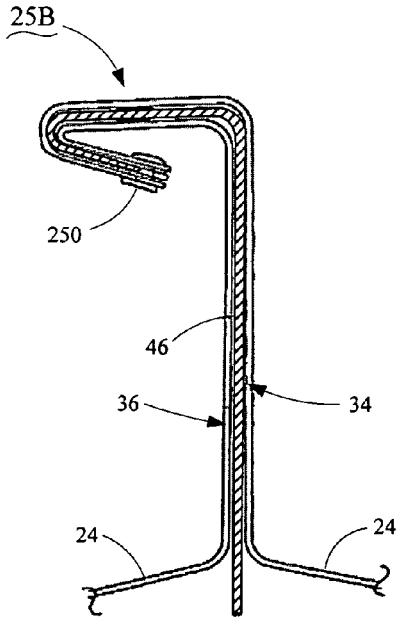
FIG. 47 is an end view of the standing seam of FIG. 46 after the corrugation has been seamed to tighten the seam and hide and protect the fastener.

FIG. 46 is an end view of yet another alternative standing seam with a clip tab between the male and female sidelaps, and having a fastener 250 inserted through the male and female sidelaps. With this configuration, the seam and clip tab prevent in plane shear movement between all three elements. Illustrated as a rivet in FIG. 46, the fastener 250 also increases the panels resistance to unfurling when subject to uplift forces. The fastener 250 is located outside (outboard) of the sealant (not shown) so water tightness of the seam is not impaired, and is applied through the last element to make the fastener 250 easy to apply. FIG. 47 is an end view of the standing seam of FIG. 46 after the corrugation has been seamed to tighten the seam and hide and protect the fastener.

Figure 48:
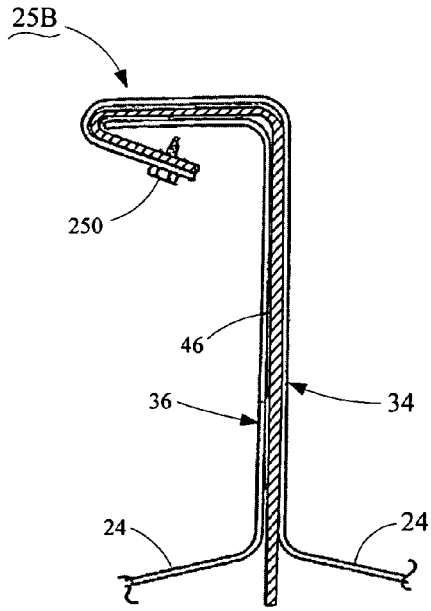
FIG. 48 is an end view of an alternative standing seam with a fastener.

FIG. 48 is an end view of an alternative standing seam with a fastener 252 attaching any two of the three elements (the male and female sidelaps and the clip) to increase in plane shear resistance between any two of the elements as required and to increase resistance to unfurling. The fastener 252 is illustrated in FIG. 48 as a self tapping, self threading screw member.

It is clear that the present invention is well adapted to carry out the objects and to attain the ends and advantages mentioned as well as those inherent therein. While presently preferred embodiments of the invention have been described for purposes of this disclosure, numerous changes may be made which will readily suggest themselves to those skilled in the art and which are encompassed within the spirit of the invention disclosed and as defined in the appended claims.

What is claimed is:

1. A roof assembly in which overlapping edges of adjacent panel members are joinable in an assembled mode to provide a seam having resistance to sidelap shear, the roof assembly comprising:

a first panel having a female sidelap along one edge thereof and forming a male insertion cavity between a first leg member and at least one other leg member of the female sidelap, one of the other leg members having a female hook portion forming a female retaining groove;

a second panel having a male sidelap along one edge thereof, the male sidelap engagable in the male insertion cavity of the first panel, the male sidelap having a male tang member, in the assembled mode the leg with the female hook portion and the male tang member brought thereby into mating contact, with the male tang member lockingly disposed in the female retaining groove of the female hook portion, the female and male sidelaps foldable such that the leg with hook portion and the male tang member are brought into adjacency to provide a standing seam between the first and second panels; and means for increasing the sidelap shear capacity between the female and male sidelaps.

2. The standing seam assembly of claim 1, in which the means for increasing sidelap shear capacity of the assembly comprises:

a pair of backer plates, one backer plate against each of the female sidelap portion and the male sidelap portion of the first and second panels, respectively; and fastening means interconnecting the backer plates to exert pressing force on the female sidelap and male sidelap to increase the resistance to sidelap shear.

3. The standing seam assembly of claim 1, in which the means for increasing sidelap shear capacity comprises:

a backer channel extending under the first and second panels; and fastener means for connecting the first and second panels to the backer channel to exert force on the first and second panels to increase resistance to sidelap shear.

4. The standing seam assembly of claim 3, further comprising a cinch plate and wherein fastener means connects the cinch plate and the backer channel with the panels sandwiched there between.

5. A standing seam roof assembly in which adjacent roof panels are positioned in overlapping edge relation and adjacent panel members are joined to form a standing seam having resistance to sidelap shear, the standing seam roof assembly comprising:

a plurality of panels having a female sidelap and a male sidelap along opposite edges thereof, the female sidelap of one panel interconnected with the male sidelap of the adjacent panel, the female sidelap comprising:

a male insertion cavity between a first leg member and at least one other leg member of the female sidelap; and one of the other leg members having a female hook portion forming a female retaining groove; and the male sidelap having a male tang member, the male sidelap engagable in the male insertion cavity in an assembled mode in which the leg with the female hook portion and the male tang member are brought into mating contact, the male tang member being thereby lockingly disposed in the female retaining groove, the female and male sidelaps foldable such that the leg with the female hook portion and the male tang member are disposed in adjacency to form the standing seam between the panels; and means for increasing the sidelap shear capacity between the female and male sidelaps of the standing seam.

6. The standing seam roof assembly of claim 5, in which the means for increasing sidelap shear capacity of the standing seam comprises:

at least one pair of backer plates, one backer plate against each of the female sidelap and the male sidelap of the adjacent panels; and fastening means interconnecting the backer plates to exert pressing force on the female sidelap and male sidelap to increase the ability of the seam to resist sidelap shear.

7. The standing seam roof assembly of claim 5, in which the means for increasing sidelap shear capacity of the assembly comprises:

a cinch plate disposed on a selected one of the adjacent panels;

a backer channel extending under the other of the female sidelap and the male sidelap of the adjacent panels; and fastener means interconnecting the cinch plate and the backer channel to exert pressing force on the panels to increase resistance to sidelap shear.

8. A standing seam roof assembly of roof panels in overlapping edge relationship of adjacent panels forming standing seams, the roof assembly comprising:

a panel having a female sidelap having plural leg portions, one leg portion and one other leg portion of the female sidelap forming a male insertion cavity, one leg portion having a female hook portion forming a female retaining groove;

an adjacent panel having a male sidelap having plural leg portions and a male tang portion, the male sidelap engagable in the male insertion cavity, in the assembled mode the leg with the female hook portion and the male tang member brought thereby into mating contact, with the male tang member lockingly disposed in the female retaining groove, the female and male sidelaps foldable such that the leg with the female hook portion and the male tang member are brought into adjacency to provide a standing seam between the first and second panels; and means for increasing the resistance of the adjacent panels to sidelap shear.

9. The standing seam roof assembly of claim 8 wherein the means for increasing sidelap shear capacity comprises:

a backer plate disposed against the female sidelap portion and a backer plate disposed against the male sidelap portion on opposing sides of the standing seam; and fastening means interconnecting the backer plates to sandwich the standing seam in pressing engagement to increase the capability of the standing seam to resist shear capacity.

10. The standing seam roof assembly of claim 8 wherein the means for increasing sidelap shear capacity comprises:

a cinch plate disposed one side of the adjacent panels, a backer channel disposed on the other side of the adjacent panels; and fastener means interconnecting the cinch plate and the backer channel to exert pressing force to increase the ability of the standing seam to resist sidelap shear.

11. A standing seam roof assembly, comprising:

a first panel having a female sidelap having a first leg portion, a female cavity, and a leg portion with a female hook adjacent the female cavity;

a second panel interacting with the female cavity, the second panel having a male sidelap with a leg portion forming a male tang, the leg with the female hook in combination with the male tang forming a standing seam between the panels in the assembled mode during which the leg with the female hook is pressed into mating contact with the male tang, the female hook and the male tang folded into adjacency in the female cavity; and means for increasing the sidelap shear capacity of the standing seam assembly.

12. The standing seam roof assembly of claim 11 wherein the means for increasing sidelap shear capacity comprises:

a pair of backer plates disposed on opposing sides of the standing seam against the female sidelap and the male sidelap; and fastening means interconnecting the backer plates for sandwiching the standing seam to increase the frictional force to resist movement between the female and male sidelaps.

13. The standing seam roof assembly of claim 11 wherein the means for increasing sidelap shear capacity of the adjacent roof panels comprises:

a cinch plate disposed on one of the roof panels;

a backer channel extending under the roof panels; and fastener means extending through the supporting roof panel for interconnecting the cinch plate and the backer channel to sandwich the roof panels.

14. A roof having adjacently disposed panels in overlapping edge relationship and forming standing seam assemblies each with a sidelap shear capacity between adjacent roof panels, comprising:

each roof panel having a female sidelap with a male insertion cavity and a leg portion forming a female hook;

each roof panel farther comprising a male sidelap having a male tang portion lockingly engagable in the male insertion cavity of the roof panel adjacent thereto, wherein the male sidelap portion is inserted into the male insertion cavity, the leg with the female hook in combination with the male tang providing a standing seam between the panels formed by pressing the leg with the female hook into mating contact with the male tang and folding the mated leg with female hook and male tang into adjacency; and means for increasing the sidelap shear capacity of the standing seam assembly.

15. The standing seam roof assembly of claim 14 wherein the means for increasing sidelap shear capacity of each standing seam assembly comprises:

a plurality of backer plates disposed on opposing sides of each standing seam assembly and against the female sidelap portions and the male sidelap portions of the panels; and fastening means connecting pairs of the backer plates for sandwiching the standing seams to exert friction increasing pressure on the standing seams to resist slipping thereof when subjected to diaphragm loading.

16. The standing seam roof assembly of claim 15 wherein the means for increasing sidelap shear capacity of each standing seam assembly comprises:

a cinch plate supported on one of the roof panels between the standing seams;

at least one backer channel extending under the panels; and fastener means extending through the supporting roof panels interconnecting the cinch plates and the backer channels to sandwich the roof panels between the cinch plates and the backer channels.

17. The standing seam assembly of claim 16 wherein the means for increasing sidelap shear capacity of the assembly further comprises a roof clip in pressing contact adjacent a first side of the tang of the male sidelap portion of the second panel, the roof clip enclosing the distal end of the tang while looping back into adjacency with a second side of the tang member to enclose a portion of the tang member.

18. A roof assembly in which overlapping edges of adjacent panel members are joinable in an assembled mode to provide a seam having resistance to relative longitudinal movement, the roof assembly comprising:

a first panel having a female sidelap along one edge thereof and forming a male insertion cavity between a first leg member and at least one other leg member of the female sidelap, one of the other leg members having a female hook portion forming a female retaining groove;

a second panel having a male sidelap along one edge thereof, the male sidelap engagable in the male insertion cavity of the first panel, the male sidelap having a male tang member, in the assembled mode the leg with the female hook portion and the male tang member brought thereby into mating contact, with the male tang member lockingly disposed in the female retaining groove of the female hook portion, the female and male sidelaps foldable such that the leg with hook portion and the male tang member are tightly brought into adjacency to provide a standing seam between the first and second panels; and means for increasing the resistance to relative longitudinal movement between the female and male sidelaps.

19. The standing seam assembly of claim 18, in which the means for increasing resistance to longitudinal movement of the assembly comprises:

a pair of backer plates, one backer plate against each of the female sidelap portion and the male sidelap portion of the first and second panels, respectively; and fastening means interconnecting the backer plates to exert pressing force on the female sidelap and male sidelap to increase the resistance to relative longitudinal movement.

20. The standing seam assembly of claim 18, in which the means for increasing resistance to relative longitudinal movement comprises:

a backer channel extending under the first and second panels; and fastener means for connecting the first and second panels to the backer channel to exert force on the first and second panels to increase resistance to relative longitudinal movement.

21. The standing seam assembly of claim 20, further comprising a cinch plate and wherein the fastener means connects the cinch plate and the backer channel with the panels sandwiched there between.

* * * * *